US010796841B1

(12) United States Patent
Folker et al.

(10) Patent No.: US 10,796,841 B1
(45) **Date of Patent: *Oct. 6, 2020**

(54) INDUCTOR WITH FLUX PATH FOR HIGH INDUCTANCE AT LOW LOAD

(71) Applicant: Universal Lighting Technologies, Inc., Madison, AL (US)

(72) Inventors: Donald Folker, Madison, AL (US); Mike LeBlanc, Huntsville, AL (US); Thomas M. Poehlman, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 350 days.

This patent is subject to a terminal disclaimer.

(21) Appl. No.: 15/496,487

(22) Filed: Apr. 25, 2017

Related U.S. Application Data

(60) Provisional application No. 62/332,793, filed on May 6, 2016.

(51) Int. Cl.
*H01F 17/04* (2006.01)
*H01F 27/24* (2006.01)
(Continued)

(52) U.S. Cl.
CPC ..... *H01F 27/24* (2013.01); *H01F 27/28* (2013.01); *H01F 41/0206* (2013.01); *H01F 41/04* (2013.01)

(58) Field of Classification Search
CPC ..... H01F 3/14; H01F 27/38; H01F 21/346
(Continued)

(56) References Cited

U.S. PATENT DOCUMENTS 3,505,544 A * 4/1970 Helms ..... G11B 5/5521 191/12 R
4,282,567 A 8/1981 Voigt
(Continued)

FOREIGN PATENT DOCUMENTS

CA 2944206 A1 * 10/2015 ..... H03K 17/954

OTHER PUBLICATIONS

Radoslaw Jez et al., "Influence of air-gap length and cross-section on magnetic circuit parameters," Excerpt from the Proceedings of the 2014 COMSOL Conference in Cambridge, 2014, 6 pages.
(Continued)

*Primary Examiner* — Elvin G Enad
*Assistant Examiner* — Joselito Baisa
(74) *Attorney, Agent, or Firm* — Patterson Intellectual Property Law, P.C.; Gary L. Montle; Jerry Turner Sewell

(57) ABSTRACT

A magnetic component has a variable inductance over a range of DC bias currents. The component includes a bobbin with a coil positioned around a passageway between first and second end flanges. First and second E-cores have respective middle legs positioned in the passageway with end surfaces of the middle legs juxtaposed within the passageway and spaced apart by a first magnetic gap. An I-bar is positioned in the passageway parallel to and spaced apart from respective first longitudinal surfaces of the middle legs to form a second magnetic gap between the I-bar and the longitudinal surface of the middle leg of the first E-core and to form a third magnetic gap between the I-bar and the longitudinal surface of the middle leg of the second E-core. The magnetic component provides higher inductances for lower bias currents and provides lower inductances for higher bias currents.

18 Claims, 20 Drawing Sheets

(51) Int. Cl.
*H01F 27/28* (2006.01)
*H01F 41/04* (2006.01)
*H01F 41/02* (2006.01)

(58) Field of Classification Search
USPC ..... 336/212, 221
See application file for complete search history.

(56) References Cited

U.S. PATENT DOCUMENTS 5,990,726 A * 11/1999 Bauer ..... H02H 7/0852 327/512
6,320,490 B1 * 11/2001 Clayton ..... H01F 30/10 336/170
7,024,753 B2 4/2006 Eisten et al.
7,345,567 B2 * 3/2008 Fujii ..... H01F 27/326 336/178
7,528,694 B2 * 5/2009 Tseng ..... H01F 3/10 336/198
8,115,582 B2 * 2/2012 Chen ..... H01F 3/12 336/160
8,120,457 B2 2/2012 Hu et al.
8,514,593 B2 8/2013 Brinlee et al.
8,610,533 B2 * 12/2013 Nussbaum ..... H01F 27/2804 212/233
9,093,212 B1 7/2015 Pinkerton et al.
2001/0039062 A1 * 11/2001 Marinis ..... H01L 21/50 438/3
2002/0097131 A1 * 7/2002 Kondo ..... H01F 3/10 336/212
2007/0236321 A1 * 10/2007 Iwai ..... H01F 30/06 336/212
2010/0085138 A1 4/2010 Vail
2010/0271164 A1 * 10/2010 Kitajima ..... H01F 3/10 336/221
2011/0037554 A1 * 2/2011 Tsai ..... H01F 27/306 336/196
2013/0207767 A1 * 8/2013 Worthington ..... H01F 27/2804 336/84 C
2013/0343091 A1 * 12/2013 Njiende T. ..... H01F 30/06 363/16
2014/0266550 A1 * 9/2014 Turnbull ..... H05K 1/165 336/200
2016/0093432 A1 * 3/2016 Chung ..... H02M 3/33569 363/21.04
2016/0141095 A1 * 5/2016 Lee ..... H01F 27/306 336/192
2017/0011836 A1 1/2017 Ma et al.

OTHER PUBLICATIONS

Ting Ge et al., "Point-of-Load Inductor with High Swinging and Low Loss at Light Load," Applied Power Electronics Conference and Exposition (APEC), 2016 IEEE, Mar. 20-24, 2016, pp. 668-675.

* cited by examiner

INDUCTOR WITH FLUX PATH FOR HIGH INDUCTANCE AT LOW LOAD

CROSS-REFERENCES TO RELATED APPLICATIONS

This application claims benefit of U.S. Provisional Patent App. No. 62/332,793 filed May 6, 2016, entitled "Inductor with Flux Path for High Inductance at Low Load," which is incorporated by reference herein in its entirety.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND OF THE INVENTION

The invention disclosed herein relates generally to inductive components, and, more particularly, relates to inductive components having inductances responsive to magnitudes of DC bias currents.

FIGS. 1-7 illustrate an example of a conventional inductor 100. The inductor has a first E-core 110 and a second E-core 112, which are inserted into a passageway 122 of a bobbin 120. Each E-core comprises a ferrite material or other suitable material. The bobbin has a first outer flange 124 and a second outer flange 126. In the illustrated example, the bobbin further includes a middle partition 130. A first coil 132 is wound around the bobbin between the first outer flange and the middle partition. A second coil 134 is wound around the bobbin between the second outer flange and the middle partition. Other embodiments may include additional partitions and additional coils. Other embodiments may also omit the middle partition and have only a single coil wound between the two outer flanges. The first and second coils are electrically connected to a plurality of pins 140 that extend from a first pin rail 142 and a second pin rail 144. The first pin rail is proximate to the first outer flange; and the second pin rail is proximate to the second outer flange.

The first E-core 110 has a middle leg 150, a first outer leg 152 and a second outer leg 154. The three legs extend perpendicularly from an inner surface 158 of a main body 156 of the first E-core. The second E-core 112 has a middle leg 160, a first outer leg 162 and a second outer leg 164. The three legs extend perpendicularly from an inner surface 168 of a main body 166 of the second E-core.

The middle leg 150 of the first E-core 110 is inserted into the passageway 122 of the bobbin 120 such that the inner surface 158 of the main body 156 of the first E-core is proximate to an outer surface 170 of the first outer flange 124. The middle leg 160 of the second E-core 112 is inserted into the passageway of the bobbin such that the inner surface 168 of the main body 166 of the second E-core is proximate to an outer surface 172 of the second outer flange 126. The inner surfaces of the main bodies of the E-cores may abut the outer surfaces of the outer flanges as shown; or the inner surfaces of the main bodies of the E-cores may be spaced apart from the outer surfaces of the flanges by a small distance. The outer legs 152, 154; 162, 164 of the two E-cores are positioned along the outer boundaries of the bobbin. When abutted as shown in FIG. 3, the two E-cores have an overall length L1 from an outer surface 174 of the main body of the first E-core to an outer surface 176 of the main body of the second E-core.

The middle legs 150, 160 of the two E-cores 110, 112 have a common width W1 between a respective first side surface 180 and a respective second side surface 182. The middle legs have a common height H1 between a respective lower surface 184 and a respective upper surface 186. The passageway 122 has a width W2 between a first inner side wall 200 and a second inner side wall 202. The passageway has a height H2 between an inner lower wall 204 and an inner upper wall 206. The width W2 of the passageway between the first and second inner side walls may be approximately the same as or slightly greater than the width W1 of the middle legs. Similarly, a height H2 of the passageway between the inner lower wall and the inner upper wall may be the same as or slightly greater than the height H1 of the middle legs. As shown in the cross-sectional views of FIGS. 3 and 7, the middle legs 150, 160 of the two E-cores 110, 112 may fit snugly within the passageway 122 with little or no lateral movement or vertical movement. In other embodiments, the widths and the heights of the middle legs may be selected such that the middle legs fit loosely within the passageway. In other embodiments, the middle legs may be constrained by crushable ribs (not shown) extending from the walls of the passageway.

In the illustrated embodiment of FIGS. 1-7, the middle leg 150 of the first E-core 110 is shorter than the first outer leg 152 and the second outer leg 154 by a first length difference LD1 (FIG. 6) such that an end surface 210 of the middle leg is closer to the inner surface 158 of the main body 156 of the first E-core than a respective end surface 212 of the first outer leg and a respective end surface 214 of the second outer leg. In the illustrated embodiment, the two outer legs have substantially the same lengths. Similarly, the middle leg 160 of the second E-core 112 is shorter than the first outer leg 162 and the second outer leg 164 by a second length difference LD2 (FIG. 6) such that an end surface 220 of the middle leg is closer to the inner surface 168 of the main body 166 of the second E-core than a respective end surface 222 of the first outer leg and a respective end surface 224 of the second outer leg.

When the middle leg 150 of the first E-core 110 and the middle leg 160 of the second E-core 112 are inserted fully into the passageway 122 of the bobbin 120, the end surface 212 of the first outer leg 152 of the first E-core abuts the end surface 222 of the first outer leg 162 of the second E-core. Similarly, the end surface 214 of the second outer leg 154 of the first E-core abuts the end surface 224 of the second outer leg 164 of the second E-core. The end surface 210 of the middle leg of the first E core is adjacent to the outer surface 220 of the middle leg of the second E-core; however, the relative shortness of the respective middle legs with respect to the respective outer legs of the two E-cores causes a magnetic gap 230 to be formed between the opposing outer surfaces of the middle legs. The magnetic gap is a conventional air gap; however, the magnetic gap may be filled with a non-magnetic material, such as, for example, a polyester film.

The gap has a gap distance GD that is equal to the sum of the two length differences LD1, LD2 (e.g., GD=LD1+LD2). When the two length differences are the same, the gap distance is substantially equal to 2×LD1 or 2×LD2. The gap distance may also be formed by making either the first length difference LD1 of the first E-core or the second length difference LD2 of the second E-core equal to the desired gap distance and making the length of the middle leg of the other E-core equal to the lengths of the respective outer legs of the other E-core. Dividing the gap distance between the middle legs of the two E-cores allows the two E-cores to be identical or substantially identical.

The inductor 100 of FIGS. 1-7 operates in a conventional manner to provide a substantially constant inductance over a wide range of load conditions. For example, FIG. 8 illustrates a graph 400 of the DC bias characteristics of a conventional single-gap inductor such as the inductor of FIGS. 1-7. As illustrated by a curve 410 in FIG. 8, the conventional inductor has an inductance of approximately 3.5 millihenries over a wide range of DC bias currents from approximately 0 amperes to approximately 1.9 amperes. At a DC bias current of approximately 1 ampere, the inductance begins to decrease as the magnetic paths through the two E-cores start to saturate; however, the decrease is gradual as the DC bias current increases from approximately 1 ampere to approximately 1.9 amperes.

For some applications, an inductor having a variable inductance is desirable. For example, in a boost inductor circuit having a variable DC load, a relatively low inductance is desirable at heavy loads to reduce losses in the inductor and to allow switching at a higher frequency. When the boost inductor circuit is operating at a lighter load, a larger inductance is desired so that the circuit can switch at a lower frequency and thereby reduce losses in the circuit at the lighter load. The desired variable inductance has been achieved thus far by using a step-gap inductor such as, for example, described in U.S. Patent Application Publication No. 2010/0085138 to Vail, entitled "Cross Gap Ferrite Cores," and in U.S. Pat. No. 9,093,212 to Pinkerton et al., entitled "Stacked Step Gap Core Devices and Methods."

FIGS. 9-13 illustrate a basic step-gap inductor 500, which is derived from the conventional inductor 100 of FIGS. 1-7 by replacing the second E-core 112 of FIGS. 1-7 with a step-gap E-core 510. The other elements of FIGS. 9-13 generally correspond to the elements of the conventional single-gap inductor of FIGS. 1-7 and are numbered accordingly.

The step-gap E-core 510 is similar to the first E-core 110 and the second E-core 112 of FIGS. 1-7. The step-gap E-core comprises a middle leg 520, a first outer leg 522 and a second outer leg 524. The three legs extend from an inner surface 532 of a main body 530. In the illustrated embodiment, the first outer leg has an end surface 540 spaced apart from the inner surface of the main body by an outer leg length, and the second outer leg has an end surface 542 spaced apart from the inner surface of the main body by substantially the same outer leg length.

In the illustrated embodiment, the first side surface 180, the second side surface 182, the lower surface 184 and the upper surface 186 of the middle leg 520 of the step-gap E-core are numbered as described above for the middle legs 150, 160 of the first and second E-cores 110, 112.

Unlike the previously described middle leg 160 of the second E-core 112 in the embodiment of FIGS. 1-7, the middle leg 520 of the step-gap E-core 510 of FIGS. 9-13 has a two-part end surface 550. A first part 552 of the end surface of the middle leg is spaced apart from the inner surface 532 of the main body 530 of the step-gap E-core by a first length corresponding to the length of the middle leg of the embodiment of FIGS. 1-7. A first portion of the middle leg of the embodiment of FIGS. 9-13, which extends from the inner surface of the main body to the first portion of the outer surface, may have the second length difference LD2 (FIG. 12) relative to the lengths of the first outer leg 522 and the second outer leg 524 as described above. A second part 554 of the outer surface of the middle leg is spaced apart from the inner surface of the main body by a greater distance. The second portion of the middle leg is shorter than the lengths of the first outer leg and the second outer leg by a third length difference LD3 (FIG. 12). In the illustrated embodiment, the third length difference LD3 is less than the second length difference LD2.

As illustrated in the cross-sectional view in FIG. 13, when the first E-core 110 and the step-gap E-core 510 are inserted into the passageway 122 of the bobbin 120, the first part 552 of the outer surface 550 of the middle leg 520 of the step-gap E-core is spaced apart from the outer surface 180 of the middle leg 150 of the first E-core by a first gap distance GD1, which may be the same as the gap distance GD of the embodiment of FIGS. 1-7. The first gap distance GD1 is the sum of the first length difference LD1 (FIG. 6) and the second length distance LD2 (FIG. 12) as described above. The second part 554 of the outer surface of the middle leg of the step-gap E-core is spaced apart from the outer surface of the middle leg of the first E-core by a second gap distance GD2, which is the sum of the first length difference LD1 and the third length difference LD2. Thus, as illustrated in FIG. 13, the second gap distance GD2 is less than the first gap distance GD1. Accordingly, a step gap 560 is formed between the first E-core and the step-gap E-core. The step gap has a first gap portion 562 having the first gap distance GD1 and has a second gap portion 564 having the second gap distance GD2. In the illustrated embodiment, the first part and the second part of the outer surface of the middle leg have approximately the same surface areas; however, the surface areas may be different in other embodiments.

The step gap 560 of the inductor 500 of FIGS. 9-13 causes the inductor to have a greater variation in DC bias characteristics over a load range. The variation in the DC bias characteristics is illustrated by a curve 810 on a graph 800 in FIG. 14. The previously described curve 410 for the inductor 100 is also shown on the graph in FIG. 14 for comparison. As illustrated by the curve 810, the inductance at lighter current loads from approximately 0 amperes to approximately 0.6 ampere is fairly steady at approximately 6.5 millihenries with a gradual reduction to about 6.25 millihenries at 0.6 ampere. The decrease in inductance is faster as the current continues to increase above 0.6 ampere because the portions of the magnetic path affected by the shorter gap 562 become saturated and reduce the contribution of the magnetic path to the inductance. Because of the saturation of the portion of the magnetic path affected by the shorter gap, the inductance of the inductor of FIGS. 9-13 continues to decrease until the inductance of the step-gap inductor is approximately the same as the inductance of the conventional inductor 100 at approximately 0.95 ampere. As the load current continues to increase, the inductance of the step-gap inductor is less than the inductance of the convention inductor because the inductance is determined by the gap distance GD1 of the longer gap 564, which has approximately the same gap distance as the gap distance GD of the single gap 200 of FIG. 3, but has about one-half the surface area (or cross-sectional area) of the single gap. Accordingly, the magnetic path including the longer gap begins to saturate at lower currents and the inductance continues to decrease as shown by the curve 810.

Although the step-gap inductor 500 provides substantial benefits in providing a greater inductance at lighter load currents, a need exists for an inductor configuration that provides even greater inductance at lighter load currents and that provides a steady inductance at heavier load currents (e.g., does not exhibit the continued rapid reduction in inductance above 1.0 ampere as shown by the curve 810 in FIG. 14). Furthermore, a need exists for an inductor having such characteristics that can be formed without having to grind the end of one of the middle legs to form the step gap or having to form one the E-cores with a two-part middle leg with one part longer than the other part.

SUMMARY OF THE INVENTION

An aspect of the embodiments disclosed herein is a magnetic component having a variable inductance over a range of DC bias currents. The component includes a bobbin with a coil positioned around a passageway between first and second end flanges. First and second E-cores have respective middle legs positioned in the passageway with end surfaces of the middle legs juxtaposed within the passageway and spaced apart by a first magnetic gap. An I-bar is positioned in the passageway parallel to and spaced apart from respective first longitudinal surfaces of the middle legs to form a second magnetic gap between the I-bar and the longitudinal surface of the middle leg of the first E-core and to form a third magnetic gap between the I-bar and the longitudinal surface of the middle leg of the second E-core. The magnetic component provides higher inductances for lower bias currents and provides lower inductances for higher bias currents.

Another aspect of the embodiments disclosed herein is a magnetic component. The magnetic component comprises a bobbin having a first end flange, a second end flange and a passageway through the bobbin from the first end flange to the second end flange. At least one coil is positioned around the passageway between the first end flange and the second end flange. The magnetic component further includes a first E-core and a second E-core. Each E-core has a respective main body, a respective middle leg, a respective first outer leg and a respective second outer leg. The legs of each E-core extend from the respective main body to respective end surfaces. The middle legs of the two E-cores are positioned in the passageway of the bobbin with the respective end surfaces of the middle legs juxtaposed within the passageway and spaced apart by a first magnetic gap. Each middle leg has a respective first longitudinal surface perpendicular to the respective end surface. A first I-bar is positioned in the passageway parallel to and spaced apart from the first longitudinal surfaces of the middle legs to form a second magnetic gap between the I-bar and the longitudinal surface of the middle leg of the first E-core and to form a third magnetic gap between the I-bar and the longitudinal surface of the middle leg of the second E-core.

In accordance with certain aspects of this embodiment, a spacer is positioned between the I-bar and the longitudinal surface of the middle leg of the first E-core. The spacer has a thickness that defines the second magnetic gap. In certain embodiments, the spacer is also positioned between the I-bar and the longitudinal surface of the middle leg of the second E-core.

In accordance with certain aspects of this embodiment, each middle leg of the magnetic component includes a respective second longitudinal surface. Each respective second longitudinal surface of each middle is parallel to the respective first longitudinal surface of the respective middle leg. A second I-bar is parallel to and spaced apart from the second longitudinal surface of the middle leg of the first E-core by a fourth magnetic gap. The second I-bar is also parallel to and spaced apart from the second longitudinal surface of the middle leg of the second E-core by a fifth magnetic gap. In certain embodiments of the magnetic component, the fourth and fifth magnetic gaps have a common length substantially the same as a common length of the second and third magnetic gaps.

Another aspect of the embodiments disclosed herein is a method for constructing a magnetic component. The method comprises positioning at least one coil onto a bobbin. The bobbin has a first end flange, a second end flange and a passageway through the bobbin from the first end flange to the second end flange. The at least one coil is positioned around the passageway of the bobbin between the first end flange and the second end flange. The method further comprises inserting the middle leg of a first E-core into a first end of the passageway proximate to the first end flange, and inserting the middle leg of a second E-core into a second end of the passageway proximate to the second end flange. Each middle leg has a respective end surface and a respective first longitudinal surface. The middle legs are positioned in the passageway with the end surfaces of the middle legs spaced apart from each other to form a first magnetic gap. The method further comprises positioning a first I-bar in the passageway parallel to and spaced apart from the longitudinal surfaces of the middle legs to form a second gap between the I-bar and the longitudinal surface of the middle leg of the first E-core and to form a third magnetic gap between the I-bar and the longitudinal surface of the middle leg of the second E-core.

In accordance with certain aspects of this embodiment, the method further comprises positioning a spacer between the first I-bar and the longitudinal surface of the middle leg of the first E-core. The spacer has a thickness that defines the second magnetic gap. In certain embodiments, the spacer is also positioned between the I-bar and the longitudinal surface of the middle leg of the second E-core.

In accordance with certain aspects of this embodiment, the method further comprises positioning a second I-bar into the passageway. The second I-bar is positioned parallel to and spaced apart from a second longitudinal surface of the middle leg of the first E-core by a fourth magnetic gap. The second I-bar is also positioned parallel to and spaced apart from the second longitudinal surface of the middle leg of the second E-core by a fifth magnetic gap. In certain embodiments of the method, the fourth and fifth magnetic gaps have a common length substantially the same as a common length of the second and third magnetic gaps.

Another aspect of the embodiments disclosed herein is a method for controlling the inductance of a magnetic component to provide a first range of inductances over a first range of DC bias currents and to provide a second range of inductances over a second range of DC bias currents. The method comprises providing a magnetic component by positioning at least one coil around a passageway of a bobbin. A first middle leg of a first E-core is inserted into the passageway from a first end of the passageway. The first middle leg has a first end surface and a first longitudinal surface, the first longitudinal surface perpendicular to the first end surface. A second middle leg of a second E-core is inserted into the passageway from a second end of the passageway. The second middle leg has a second end surface and a second longitudinal surface. The second longitudinal surface is perpendicular to the second end surface. The second end surface is parallel to and spaced apart from the first end surface by a first magnetic gap. A first I-bar is inserted into the passageway. The first I-bar has a third longitudinal surface parallel to and spaced apart from the first longitudinal surface by a second magnetic gap. The third longitudinal surface is also parallel to and spaced apart from the second longitudinal surface by a third magnetic gap. The method further includes applying a first DC bias current to the at least one coil. The first DC bias current has a first magnitude in a first range of current magnitudes. The currents in the first range of current magnitudes are selected to be less than a current magnitude that saturates a magnetic path through the second magnetic gap, the third magnetic gap and the I-bar. The magnetic component has a first range of inductances when the magnitude of the DC bias current is in the first range of current magnitudes. The method further includes applying a second DC bias current to the at least one coil. The second DC bias current has a magnitude in a second range of current magnitudes. The currents in the second range of current magnitudes are selected to have magnitudes at least sufficient to cause the magnetic path through the second magnetic gap, the third magnetic gap and the I-bar to saturate. The magnetic component has a second range of inductances when the magnitude of the DC bias current is in the second range of current magnitudes. Each inductance in the second range of inductances is less than inductances in the first range of inductances.

In accordance with certain aspects of this embodiment, the method further comprises positioning a spacer between the first I-bar and the longitudinal surface of the middle leg of the first E-core. The spacer has a thickness that defines the second magnetic gap. In certain embodiments, the spacer is also positioned between the I-bar and the longitudinal surface of the middle leg of the second E-core.

In accordance with certain aspects of this embodiment, the method further comprises positioning a second I-bar into the passageway. The second I-bar is positioned parallel to and spaced apart from a second longitudinal surface of the middle leg of the first E-core by a fourth magnetic gap. The second I-bar is also positioned parallel to and spaced apart from the second longitudinal surface of the middle leg of the second E-core by a fifth magnetic gap. In certain embodiments of the method, the fourth and fifth magnetic gaps have a common length substantially the same as a common length of the second and third magnetic gaps.

DETAILED DESCRIPTION OF THE INVENTION

In the following description, a reference to a "gap," and "air gap," or a "magnetic gap" is a reference to a discontinuity in the magnetically permeable material forming a core. The gap may be a filled space or an unfilled space between adjacent magnetically permeable materials. References herein to the "gap length," are used to refer to the distance between two surfaces that form the boundaries of a gap. The term "gap distance" may also be used to represent the distance between the boundary surfaces of the gap. The boundary surfaces of a gap may have lengths and widths that define the area or the cross-section of the gap; however, the term "gap length" is used only to refer to the distance between boundary surfaces.

Figure 1:
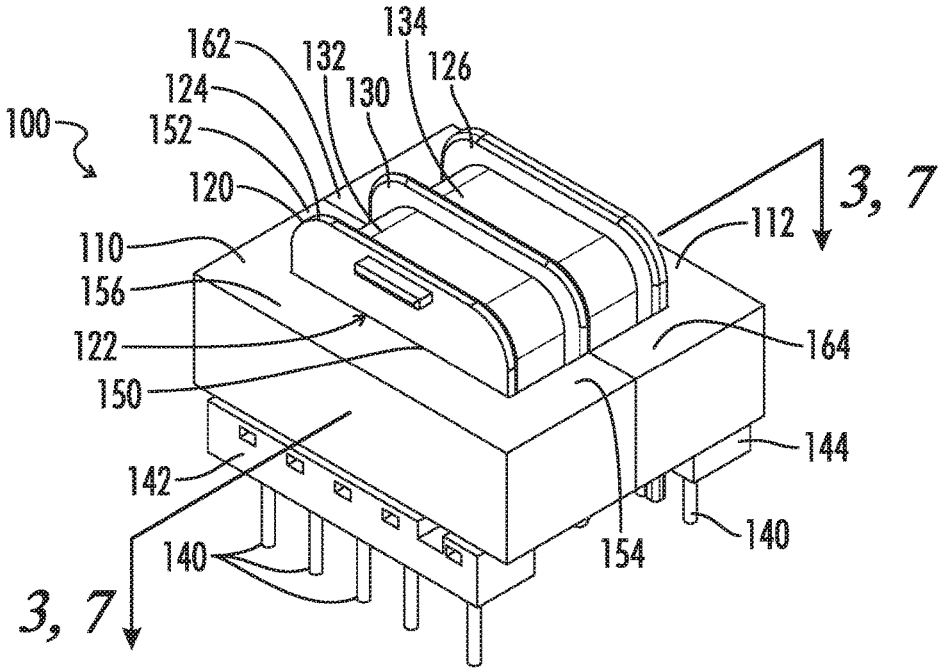
FIG. 1 (PRIOR ART)
FIG. 1 illustrates a perspective view of a conventional magnetic device having a bobbin and two E-cores.
Figure 2:
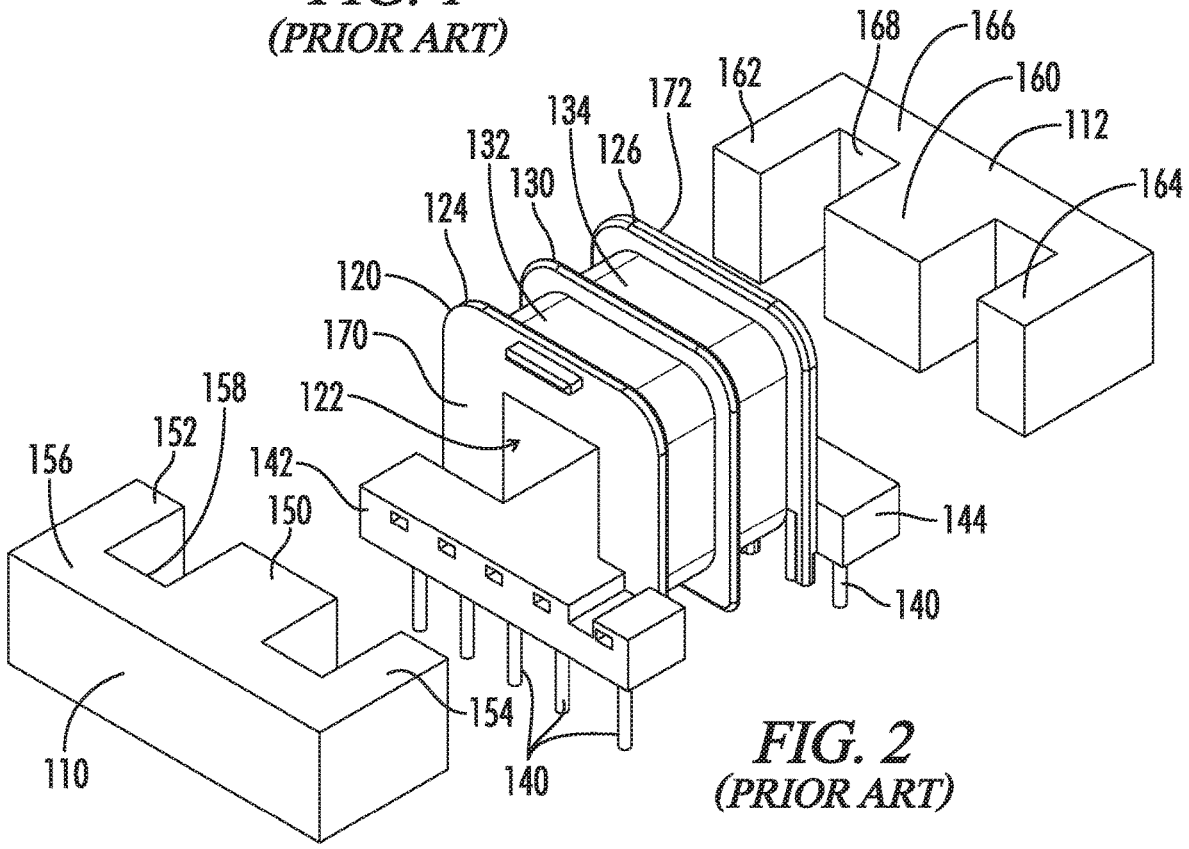
FIG. 2 (PRIOR ART)
FIG. 2 illustrates an exploded perspective view of the magnetic device of FIG. 1.
Figure 3:
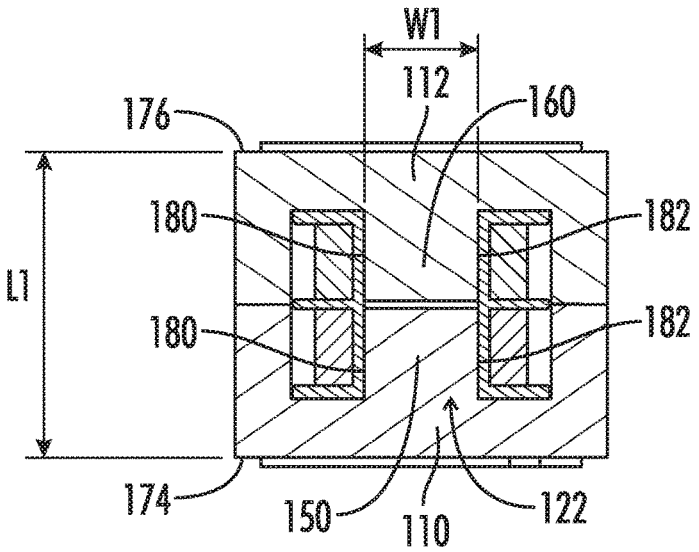
FIG. 3 (PRIOR ART)
FIG. 3 illustrates a plan cross-sectional view of the magnetic device of FIG. 1 taken along the line 3-3 in FIG. 1.
Figure 4:
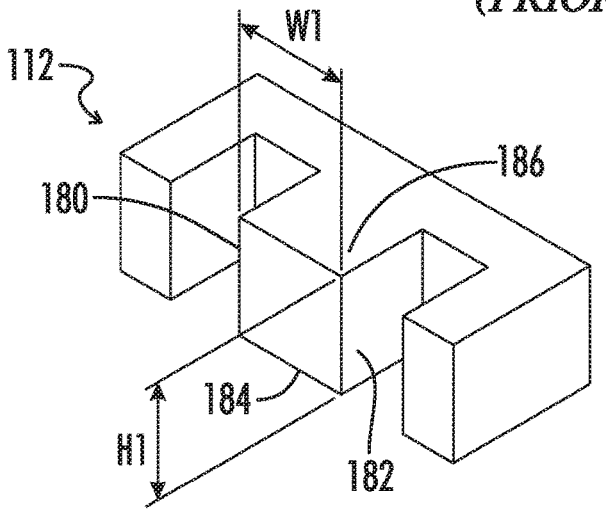
FIG. 4 (PRIOR ART)
FIG. 4 illustrates a perspective view of the second E-core of FIGS. 1-3.
Figure 5:
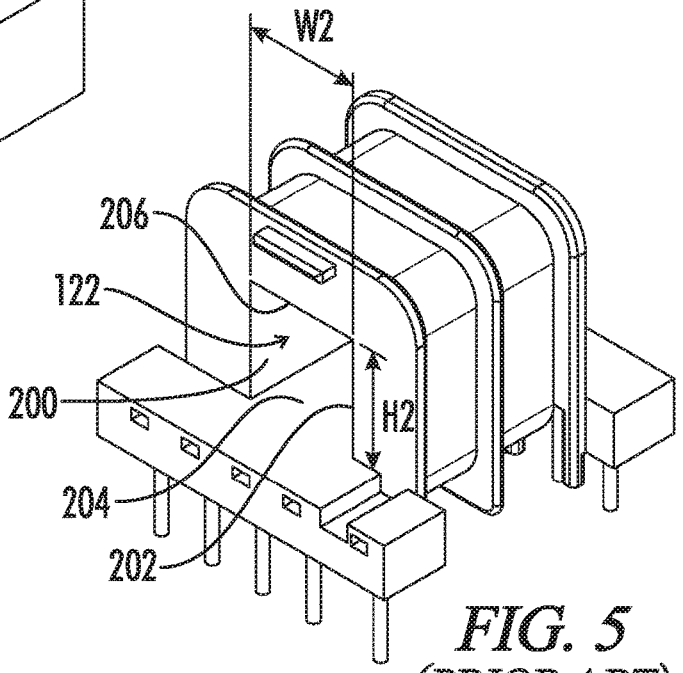
FIG. 5 (PRIOR ART)
FIG. 5 illustrates a perspective view of the bobbin of FIGS. 1-3.
Figure 6:
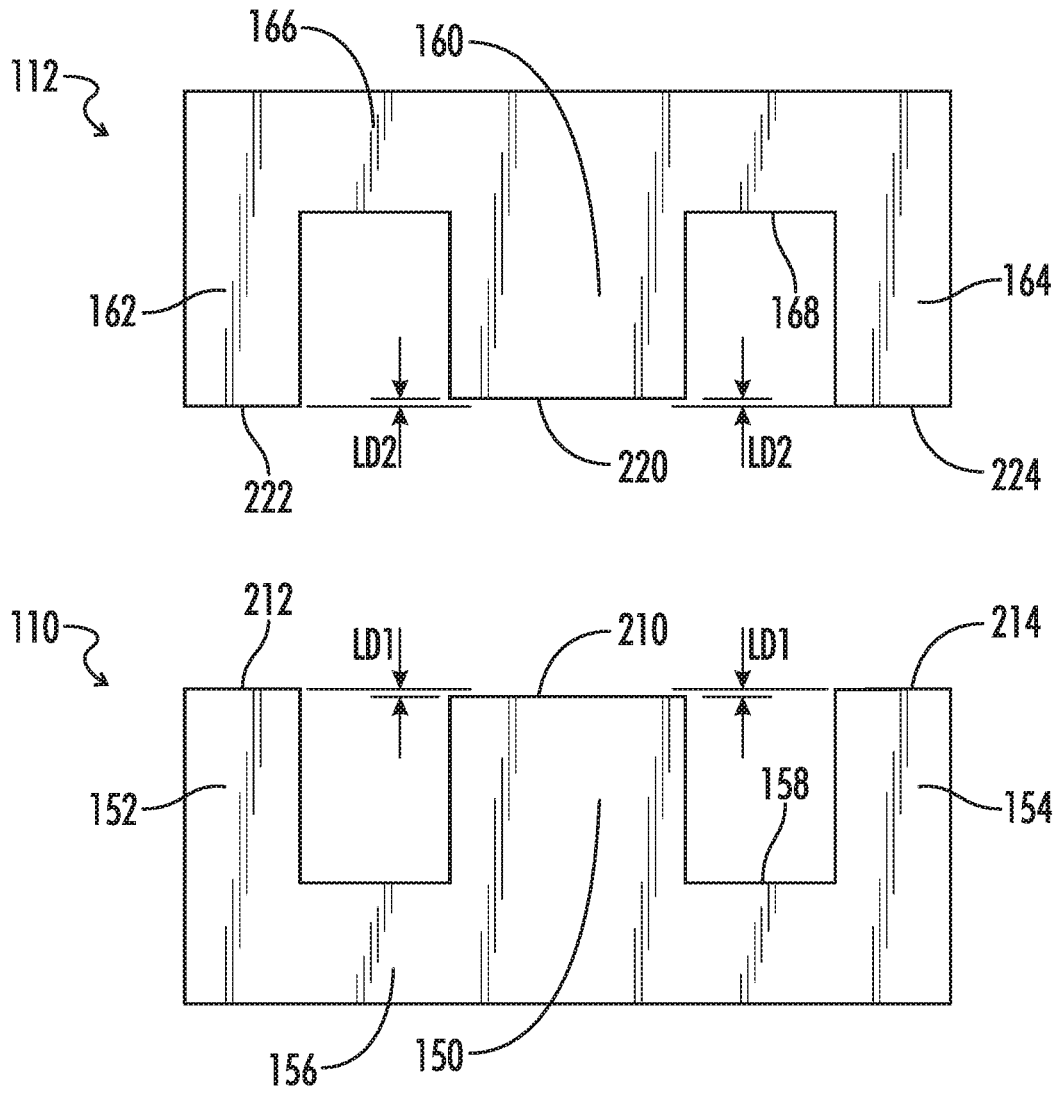
FIG. 6 (PRIOR ART)
FIG. 6 illustrates a top plan view of the first and second E-cores of FIGS. 1-3.
Figure 7:
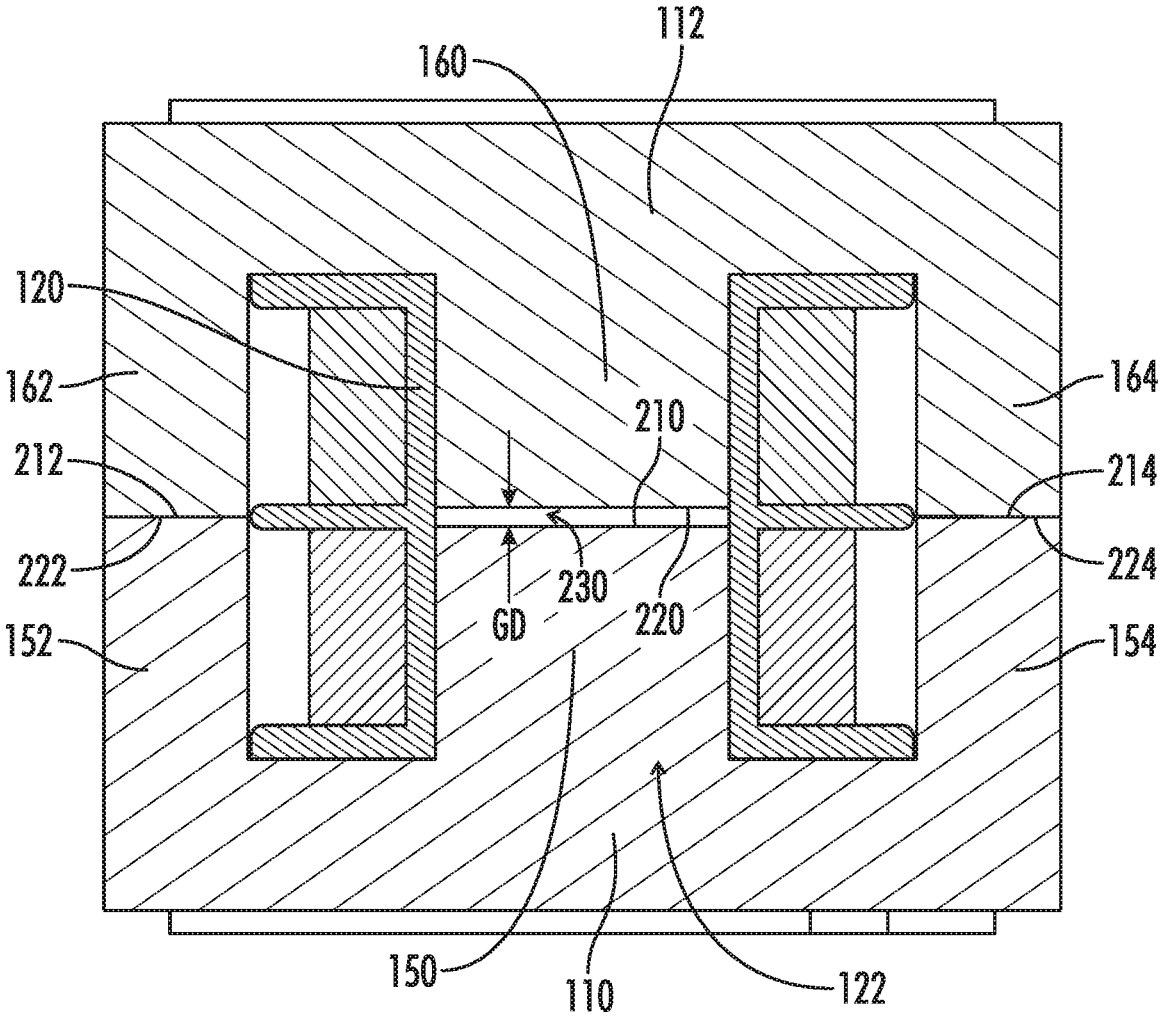
FIG. 7 (PRIOR ART)
FIG. 7 illustrates an enlarged plan cross-sectional view of the magnetic device of FIG. 1 taken along the line 7-7 in FIG. 1.
Figure 8:
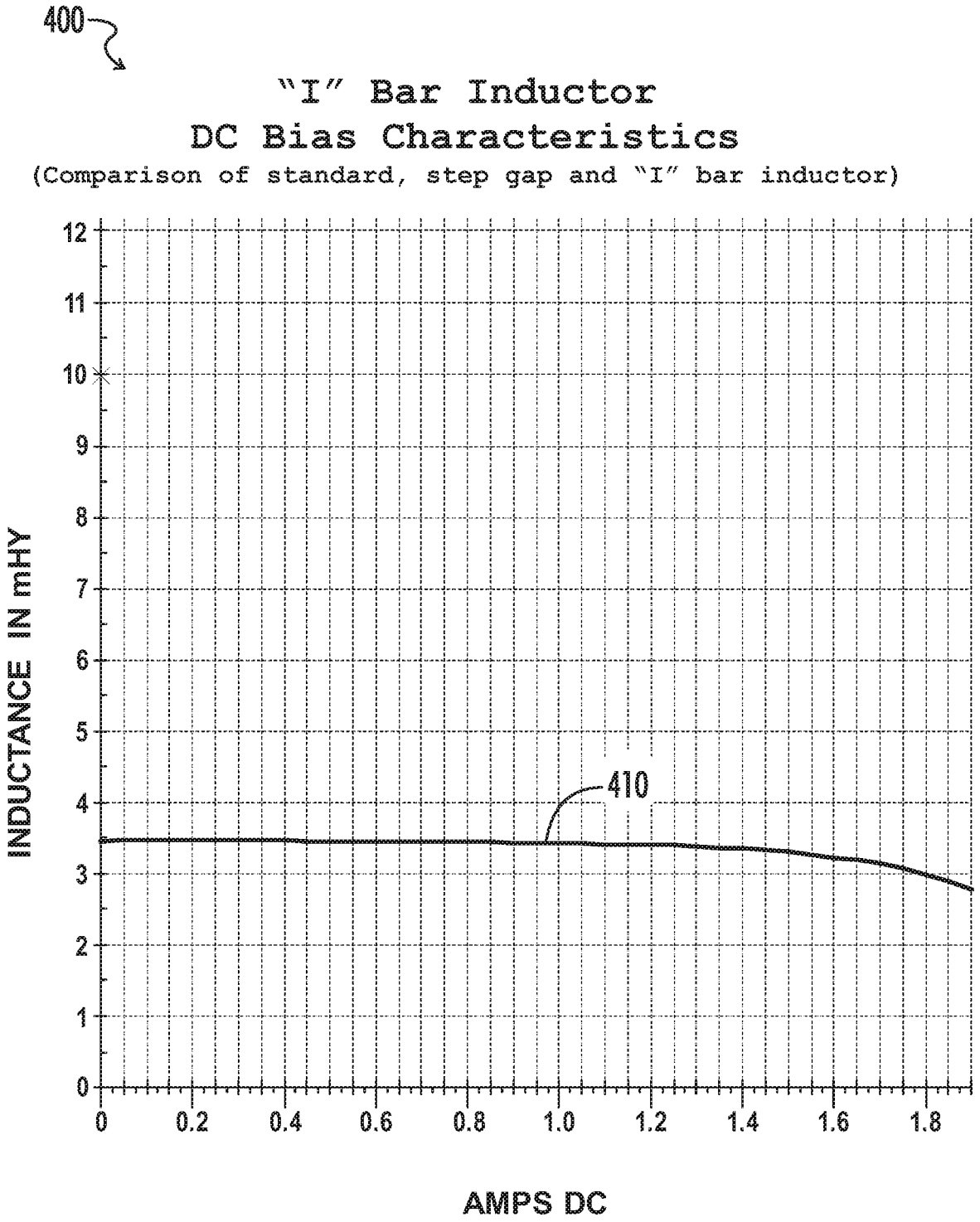
FIG. 8 illustrates a graph of the DC bias characteristics of the magnetic component of FIGS. 1-7.
Figure 9:
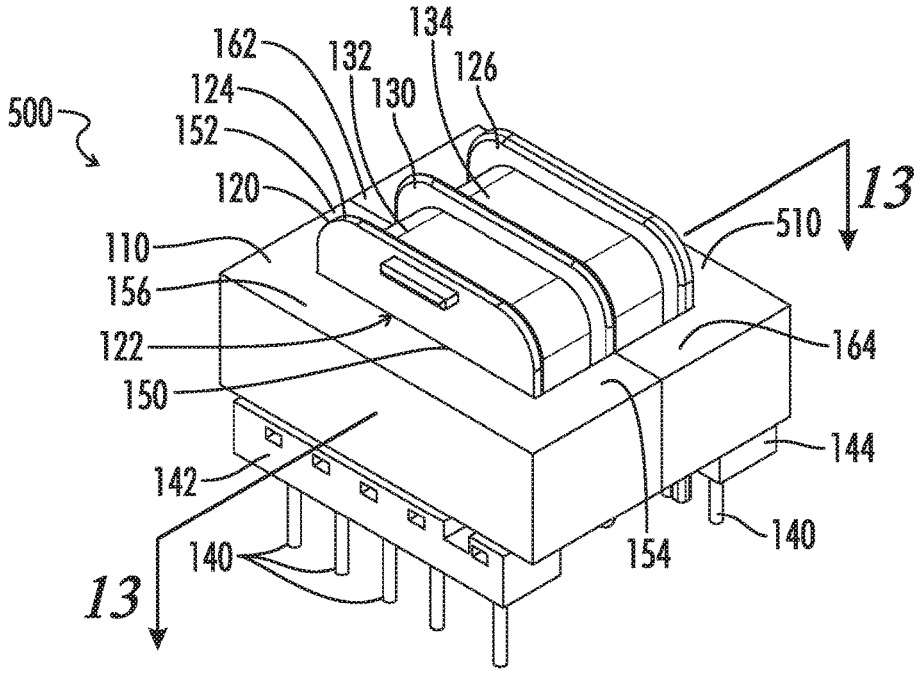
FIG. 9 (PRIOR ART)
FIG. 9 illustrates a perspective view of a magnetic component having a bobbin, an E-core with a conventional end surface of the middle leg and an E-core having a stepped end surface.
Figure 10:
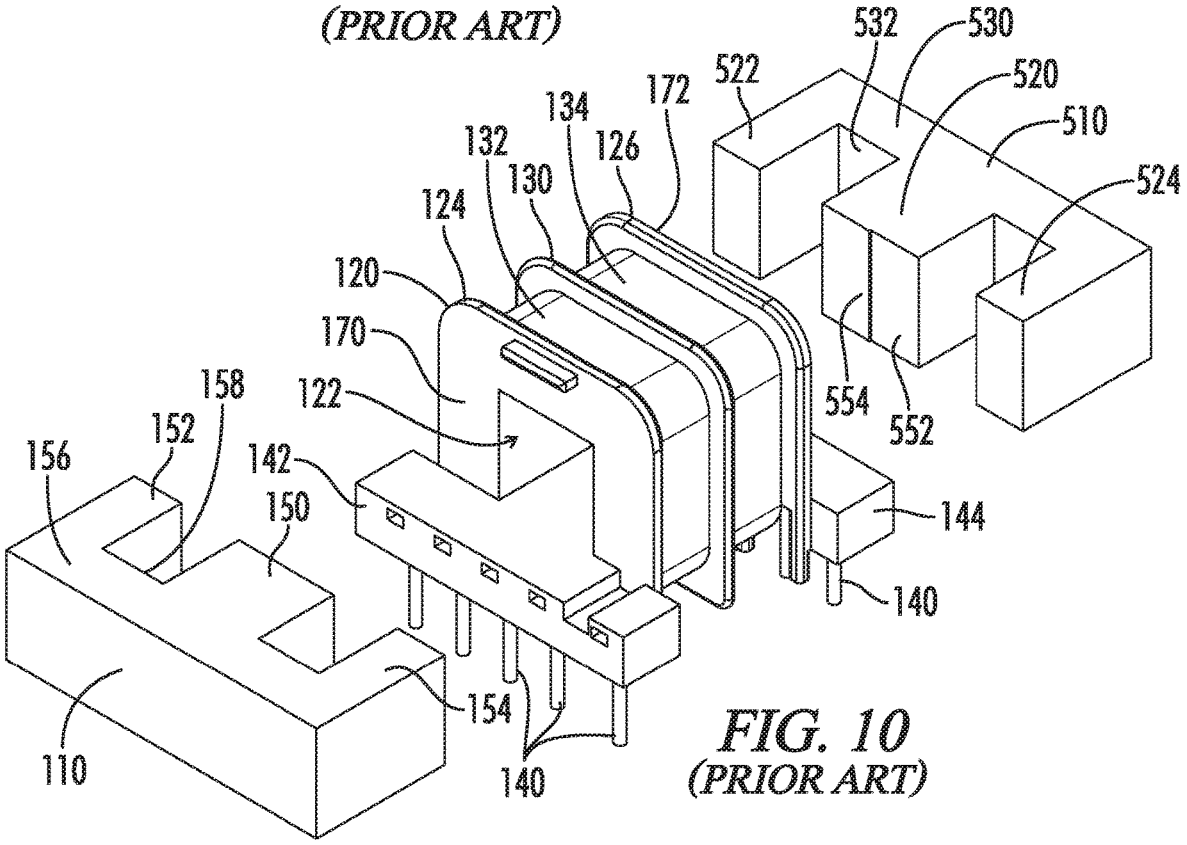
FIG. 10 (PRIOR ART)
FIG. 10 illustrates an exploded perspective view of the magnetic device of FIG. 5.
Figure 11:
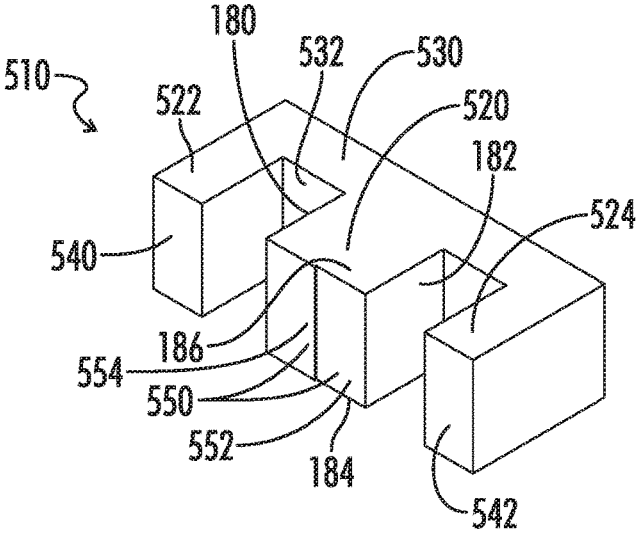
FIG. 11 (PRIOR ART)
FIG. 11 illustrates a perspective view of the step-gap E-core of FIGS. 9-10.
Figure 12:
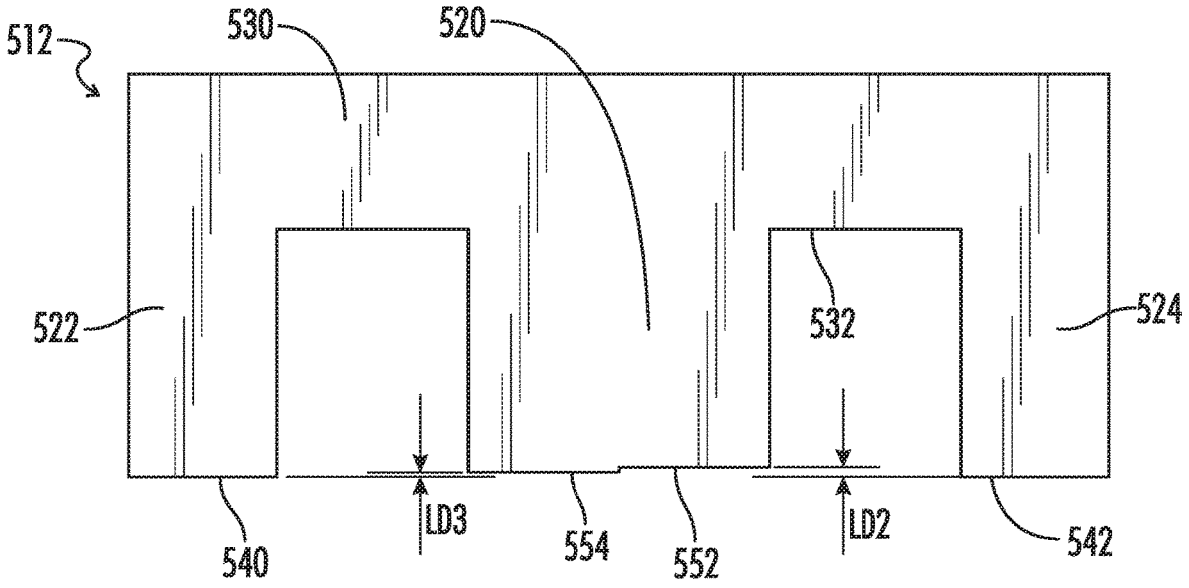
FIG. 12 (PRIOR ART)
FIG. 12 illustrates a top plan view of the step-gap E-core of FIG. 11.
Figure 13:
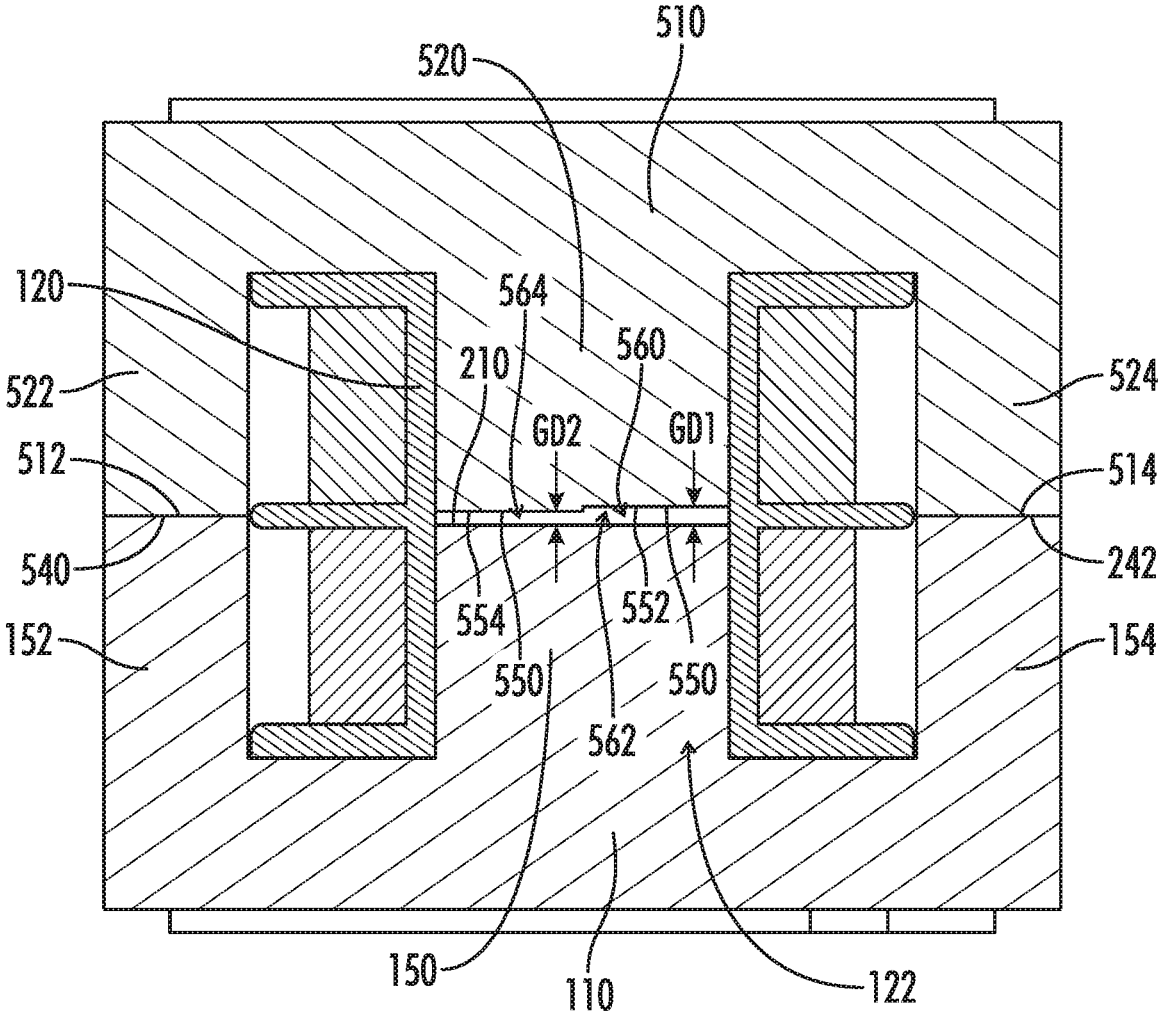
FIG. 13 illustrates a plan cross-sectional view of the magnetic device of FIG. 9 taken along the line 13-13 in FIG. 9.
Figure 14:
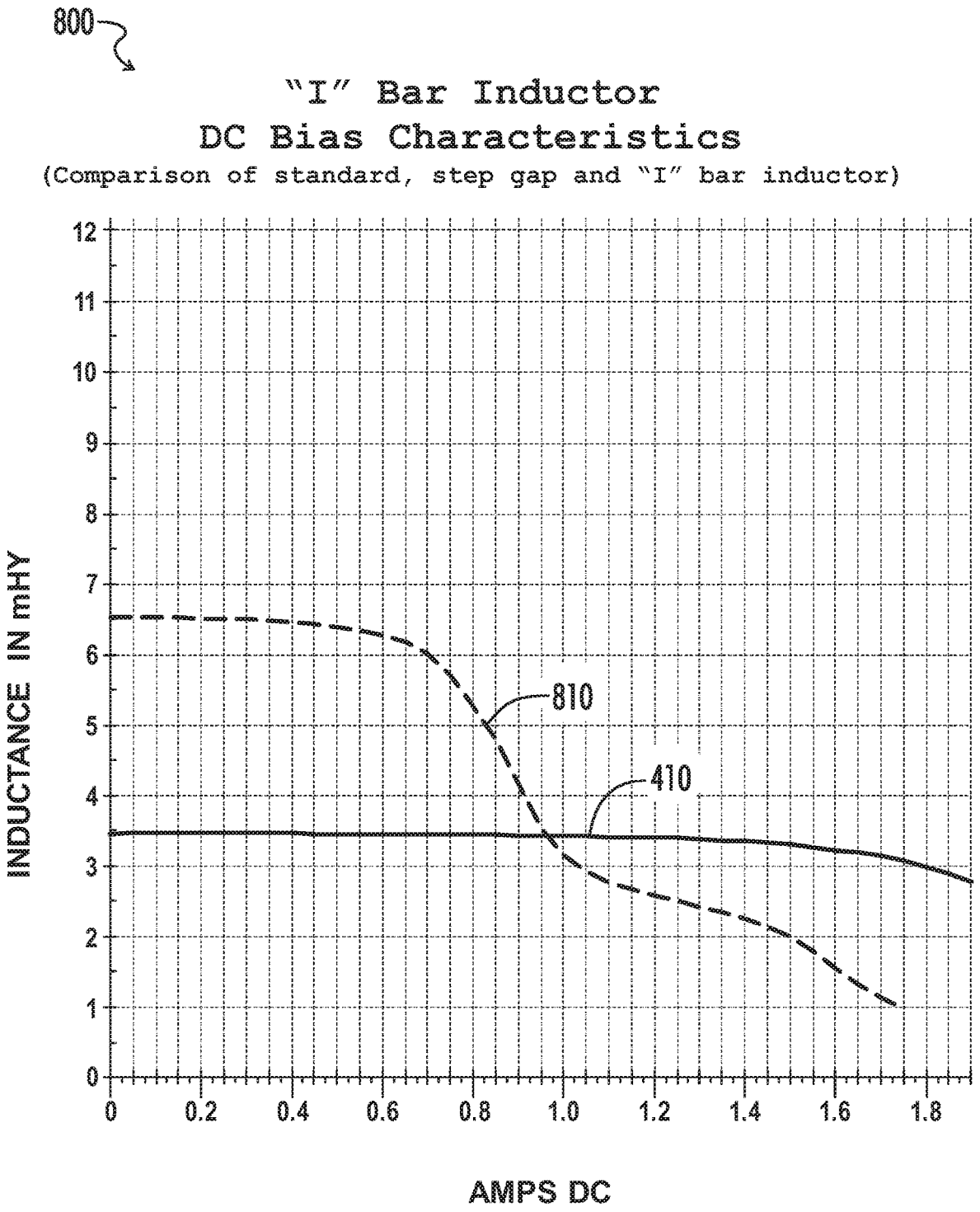
FIG. 14 illustrates a graph of the DC bias characteristics of the magnetic component of FIGS. 9-13 in comparison with the DC bias characteristics of the magnetic component of FIGS. 1-7.
Figure 15:
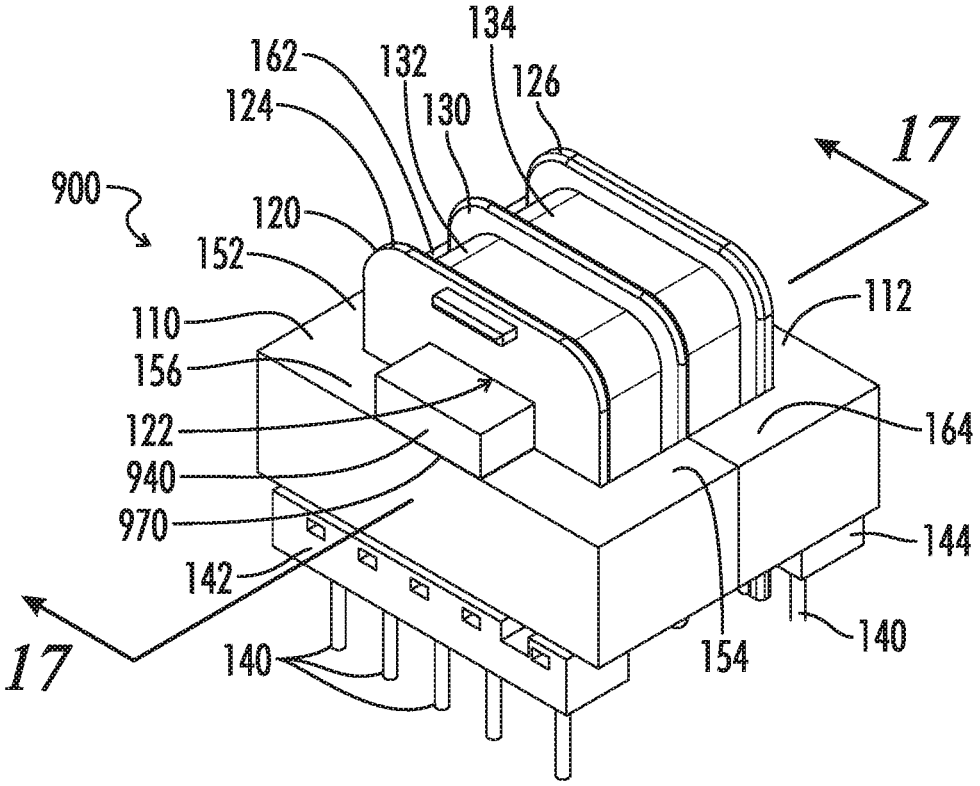
FIG. 15 illustrates a perspective view of a magnetic component having a bobbin, two E-cores and an I-bar extending along the lengths of the middle legs of the two E-cores.
Figure 16:
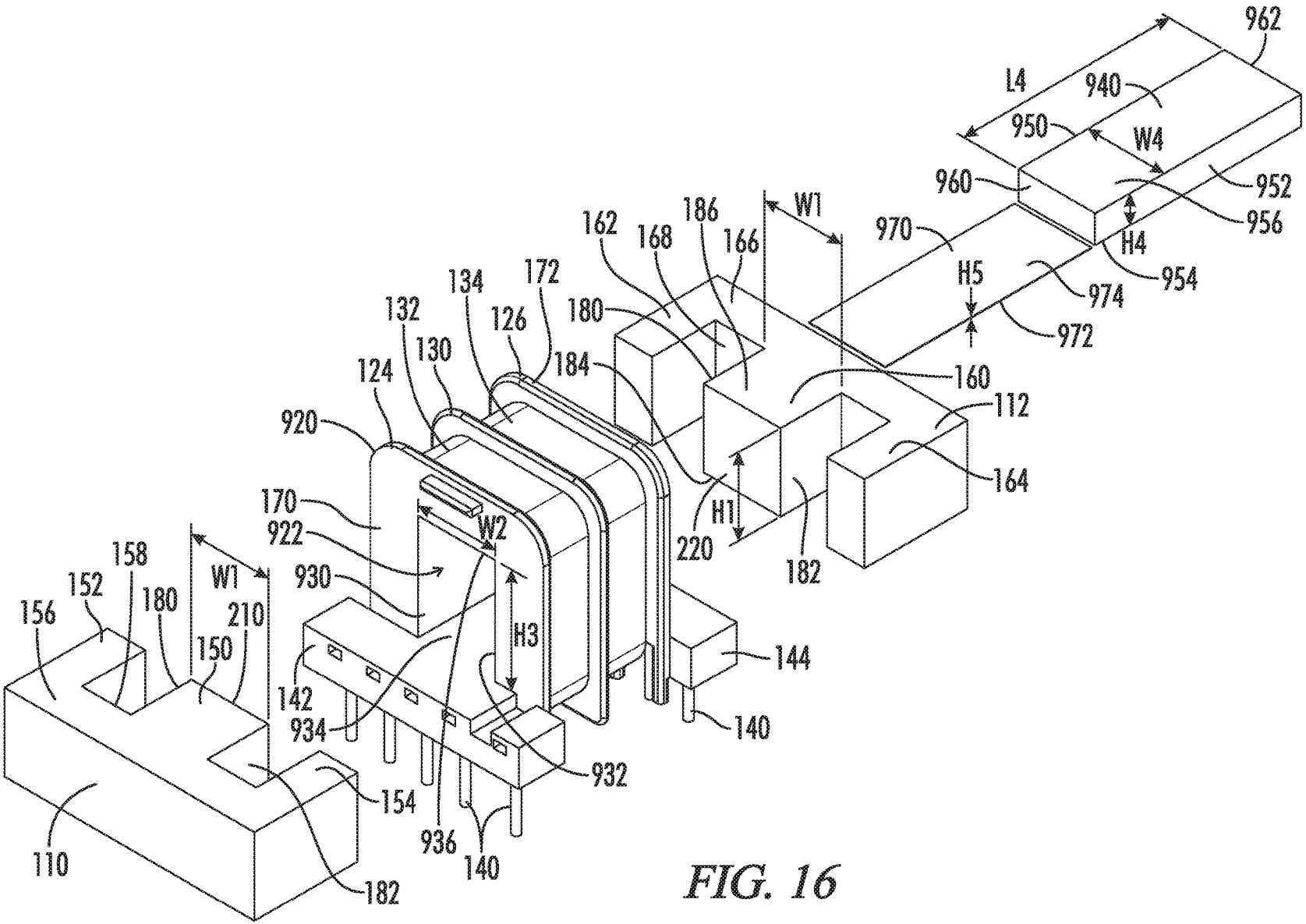
FIG. 16 illustrates an exploded perspective view of the magnetic device of FIG. 15.
Figure 17:
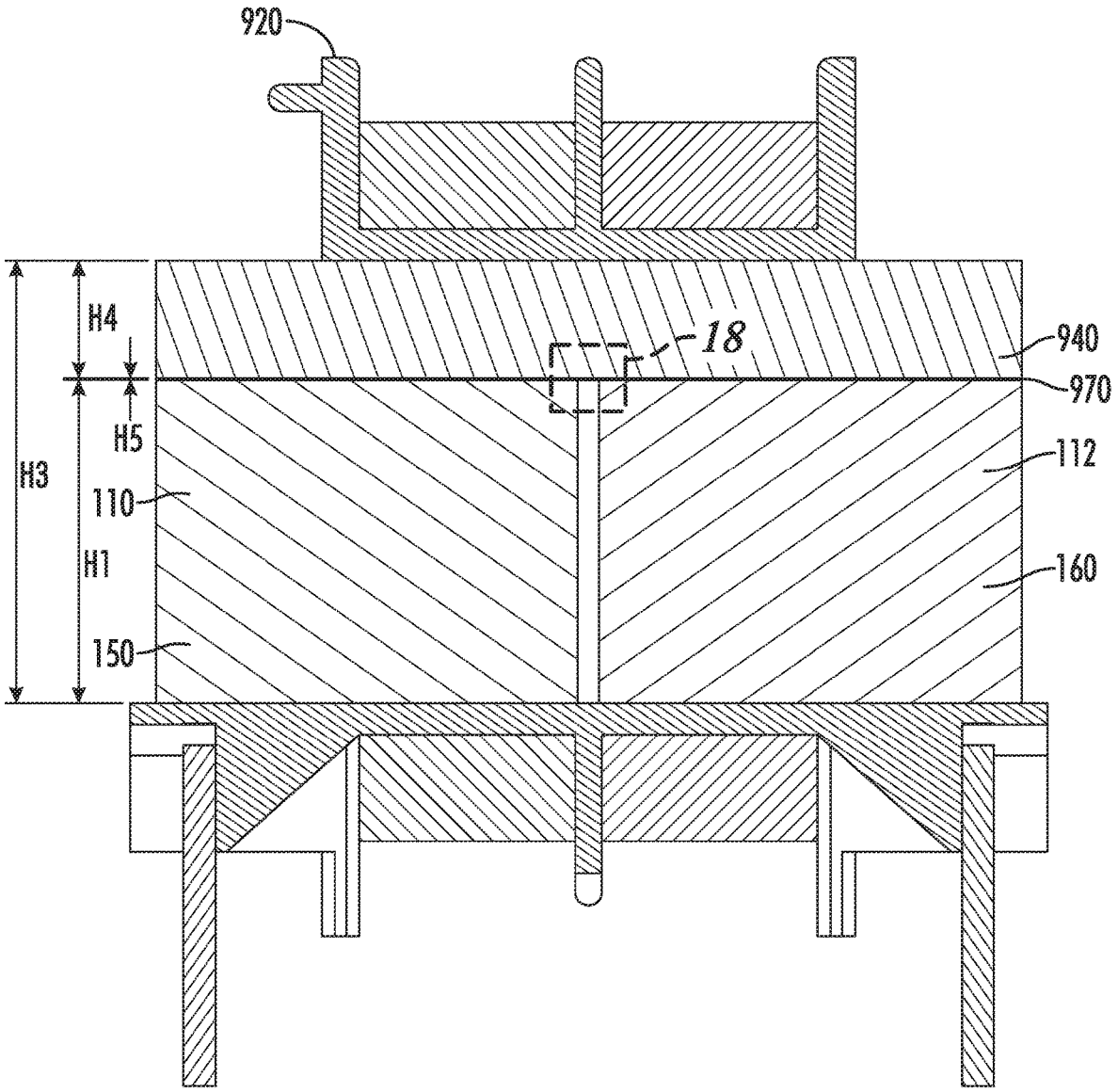
FIG. 17 illustrates an elevational cross-sectional view of the magnetic device of FIG. 15 taken along the line 17-17 in FIG. 15.

FIGS. 15-18 illustrate an inductor 900 configured in accordance with an embodiment of the present invention. The inductor comprises the first E-core 110 and the second E-core 112, which correspond to the two like-numbered E-cores of FIGS. 1-7. Accordingly, corresponding features of the two E-cores of FIGS. 15-18 are numbered in like manner. As shown in FIG. 16, the middle legs 150, 160 of the E-cores have the common width W1 between the respective first side surface 180 and the respective second side surface 182. The middle legs have the common height H1 between the respective lower surface 184 and the respective upper surface 186.

The inductor 900 includes a bobbin 920 having a passageway 922. The other features of the bobbin generally correspond to the features of the bobbin 120 of FIGS. 1-7 and are numbered accordingly. The passageway has the width W2 between a first inner side surface 930 and a second inner side surface 932. In the illustrated embodiment, the width W2 of passageway may be the same as or slightly greater than the width W1 of the middle legs 150, 160 of the E-cores 110, 112 as previously described. The passageway has a height H3 between a lower inner surface 934 and an upper inner surface 936. As described below, the height H3 of the passageway in FIGS. 15-18 is greater than the common height H1 of the middle legs of the E-cores.

The additional height of the passageway 922 is provided to accommodate an I-bar 940. The I-bar comprises a ferrite material and is configured as a rectangular parallelepiped having a first side surface 950, a second side surface 952, a lower surface 954, an upper surface 956, a first end surface 960 and a second end surface 962.

The I-bar 940 has a length L4 between the first end surface 960 and the second end surface 962. In the illustrated embodiment, the length L4 of the I-bar is approximately the same as the length L1 of the two combined E-cores 110, 112. In other embodiments, the length L4 of the I-bar may be greater than or less than the length L1. For example, the length L4 may be less than the length L1.

The I-bar 940 has a width W4 between the first side surface 950 and the second side surface 952. In the illustrated embodiment, the width W4 of the I-bar is approximately the same as the width W1 of the middle legs 150, 160 of the two E-cores 110, 112. In other embodiments, the width W4 may differ from the width W1. For example, the width W4 may be narrower than the width W1.

The I-bar 940 has a height H4 between the lower surface 954 and the upper surface 956. The height H4 of the I-bar is selected such that when the I-bar is positioned in the passageway 922 of the bobbin 920, the I-bar fits between the upper surfaces 186 of the middle legs and the upper inner surface 936 of the passageway. In particular, the height H3 of the passageway 922 is greater than the common height H1 of the middle legs by a distance slightly greater than the height H4 of the I-bar. The I-bar may also be positioned below the lower surfaces 184 of the middle legs of the E-cores.

The slight difference in the total height (H1+H4) of the middle legs 150, 160 and the I-bar 940 and the height H3 of the passageway 922 allows a spacer 970 to be inserted between the upper surfaces of the middle legs of the E-cores and the lower surface of the I-bar. For example, the spacer may have a height H5 between a lower surface 972 and an upper surface 974. When installed as illustrated in FIGS. 15-18, the total height (H1+H4+H5) of the middle legs, the I-bar and the spacer is approximately equal to the height H3 of the passageway. In the illustrated embodiment, the spacer has a length and a width corresponding to the length L4 and the width W4 of the I-bar. Although illustrated as having a length and width corresponding to the length and width of the I-bar, the spacer may have smaller dimensions. For example, the spacer may be segmented, with segments positioned at locations selected to displace the lower surface of the I-bar away from the upper surfaces of the middle legs of the E-core. In the illustrated embodiment, the spacer may comprise a polyester film having a thickness of approximately 0.05 millimeter. The spacer may also comprise a thin layer of tape adhered to the lower surface of the I-bar. The thickness of the spacer may be varied to increase or decrease the distance between the parallel lower surface of the I-bar and the upper surfaces of the two middle legs.

Figure 18:
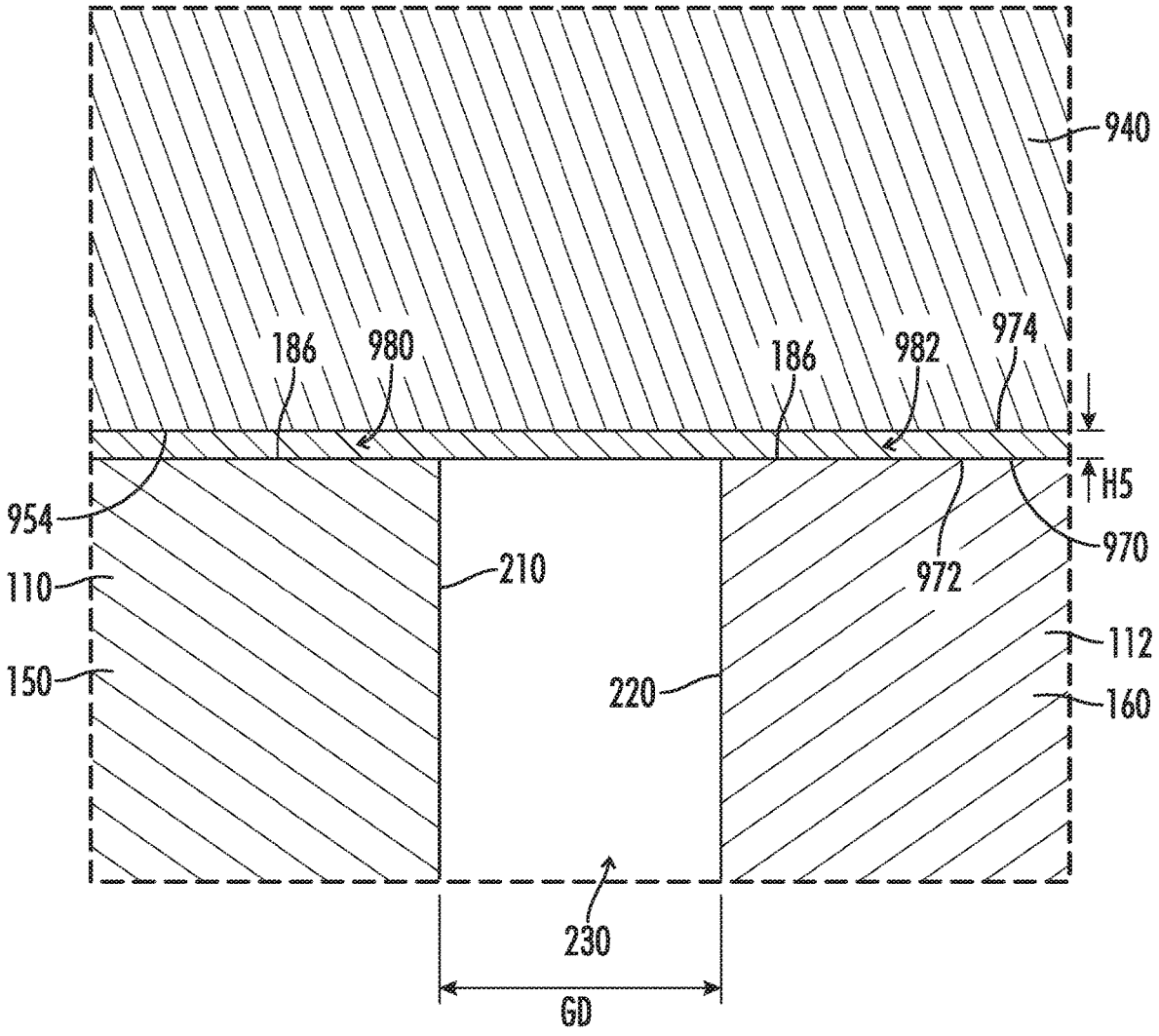
FIG. 18 illustrates an enlarged elevational cross-sectional view of the magnetic device of FIG. 15 taken within the dashed area 18 of FIG. 17.

As illustrated in FIG. 18, the spacer 970 forms a first thin magnetic gap 980 between the lower surface 954 of the I-bar 940 and the upper surface 186 of the middle leg 150 of the first E-core 110. The spacer forms a second thin magnetic gap 982 between the lower surface of the I-bar and the upper surface 186 of the middle leg 160 of the second E-core 112. Each thin gap has a height between the adjacent parallel surfaces that is much shorter (in the direction perpendicular to the adjacent, spaced-apart surfaces) than the conventional gap 230 between the end surfaces 210, 220, respectively, of the middle legs 150, 160 of the two E-cores 110, 122. In the illustrated embodiment, the height of the spacer determines the height of the gap, and the gap has the height H5. The spacing between adjacent parallel surfaces is referred to herein as the "gap distance" or "gap height" of the thin gaps. For example, the gap distance of the single large gap 230 between the end surfaces of the middle legs may be 0.25 millimeters in comparison to the 0.05 millimeter gap distance of each of the thin gaps 980, 982 between the I-bar and the upper surfaces of the middle legs. Each thin gap also has a much larger surface area than the conventional gap formed between the end surfaces of the two middle legs. The larger surface areas defining the two thin gaps and the shorter gap distances of the two thin gaps compared to the conventional gap cause the magnetic reluctance of the magnetic path through the two thin gaps and the I-bar to be much lower than the magnetic reluctance of the magnetic path through the conventional gap with the smaller gap area and the larger gap distance.

Figure 19:
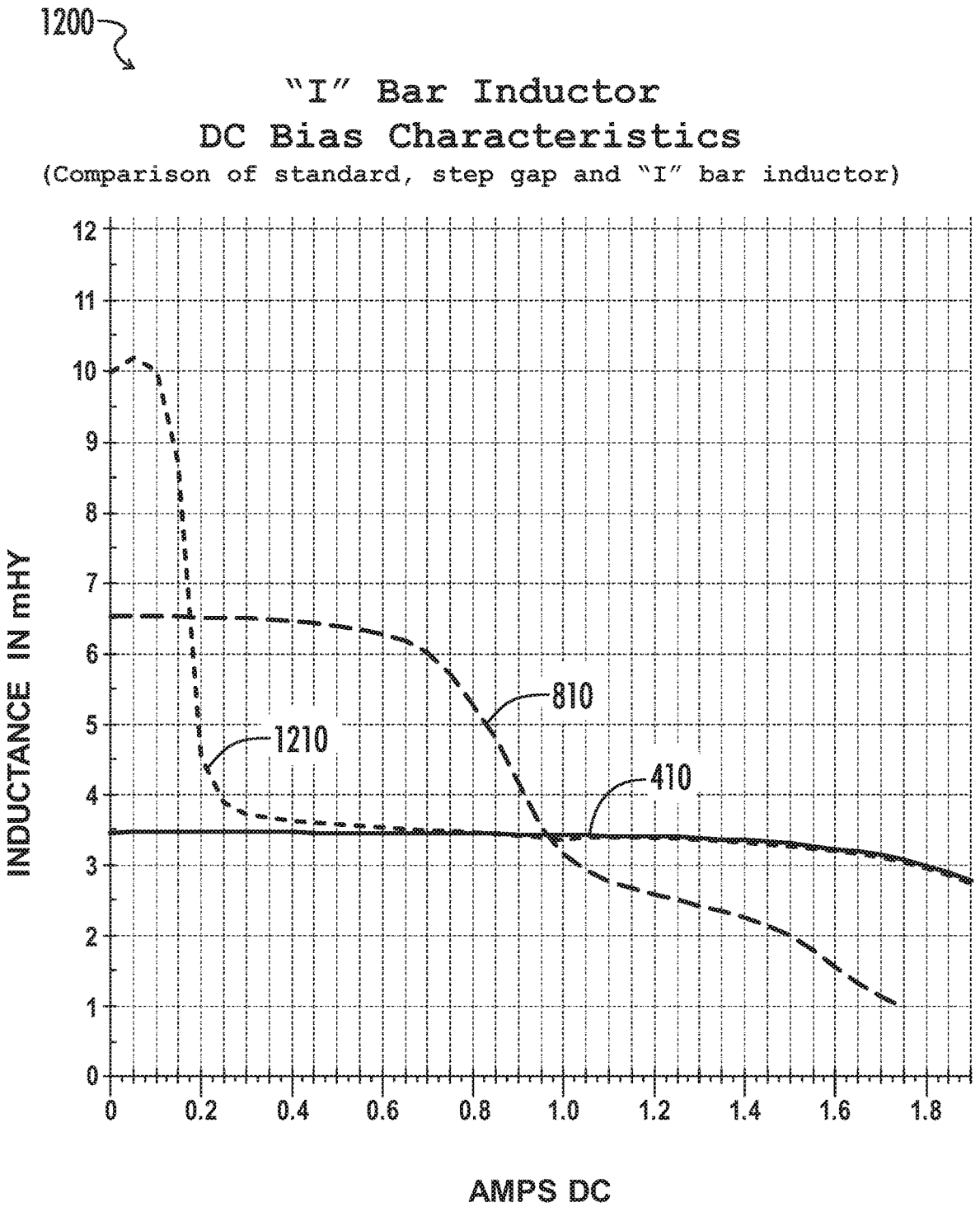
FIG. 19 illustrates a graph of the DC bias characteristics of the magnetic component of FIGS. 15-18 in comparison with the DC bias characteristics of the magnetic component of FIGS. 1-7 and the DC bias characteristics of the magnetic component of FIGS. 9-13.
Figure 20:
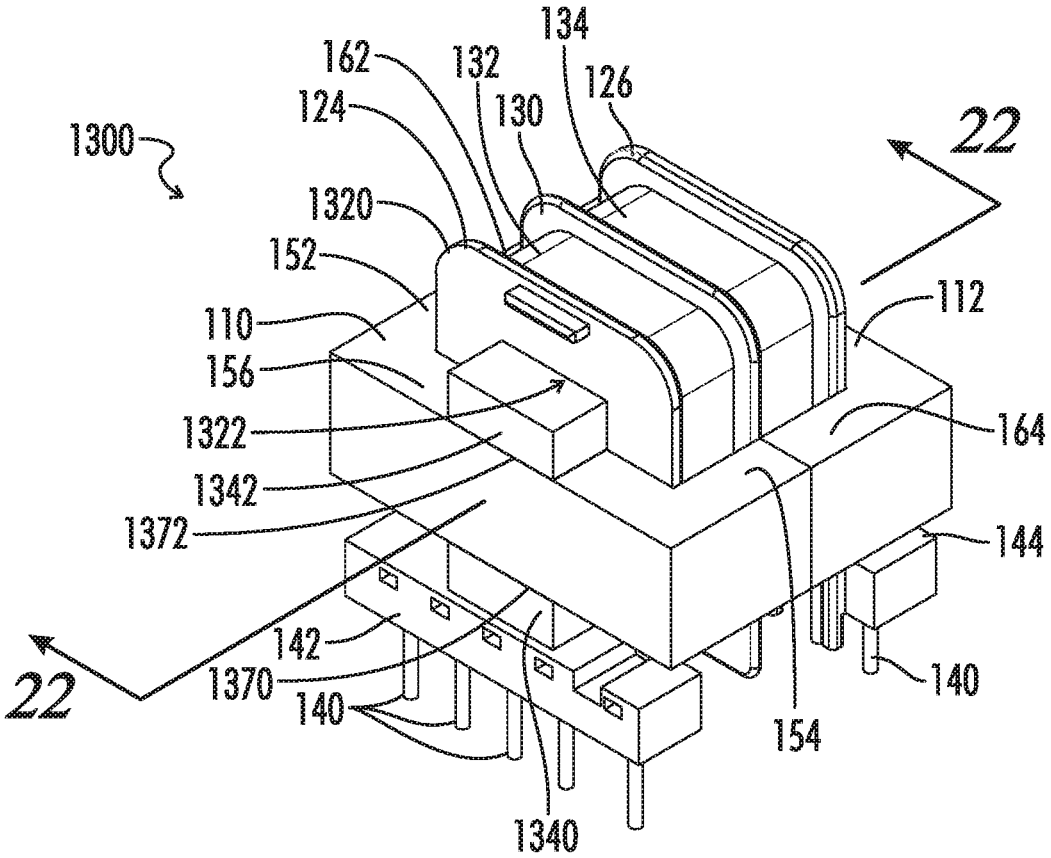
FIG. 20 illustrates a perspective view of a magnetic component having a bobbin, two E-cores, a first I-bar extending along the lengths of the upper surfaces of the middle legs of the two E-cores, and a second I-bar extending along the lengths of the lower surfaces of the middle legs of the two E-cores
Figure 21:
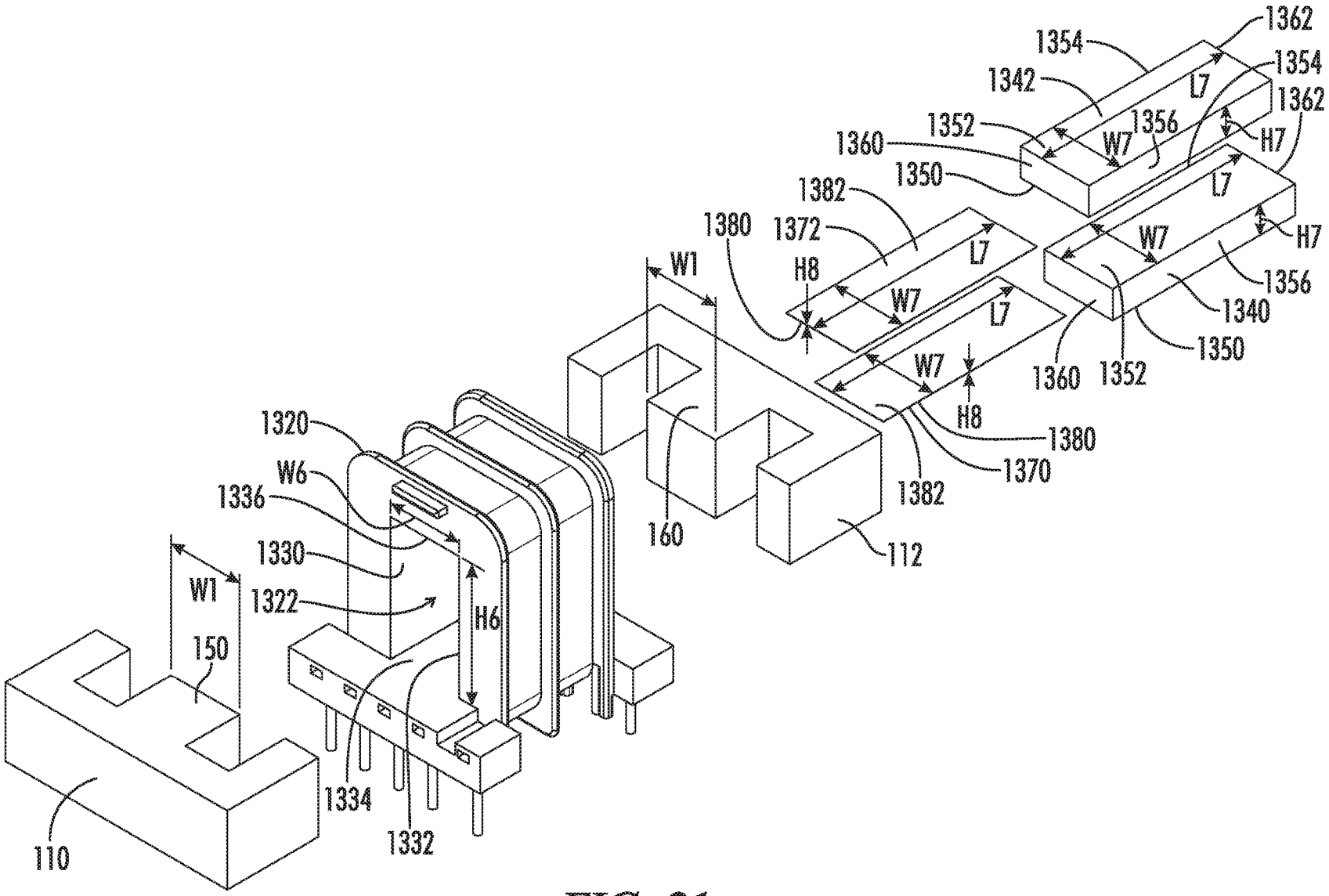
FIG. 21 illustrates an exploded perspective view of the magnetic device of FIG. 20.
Figure 22:
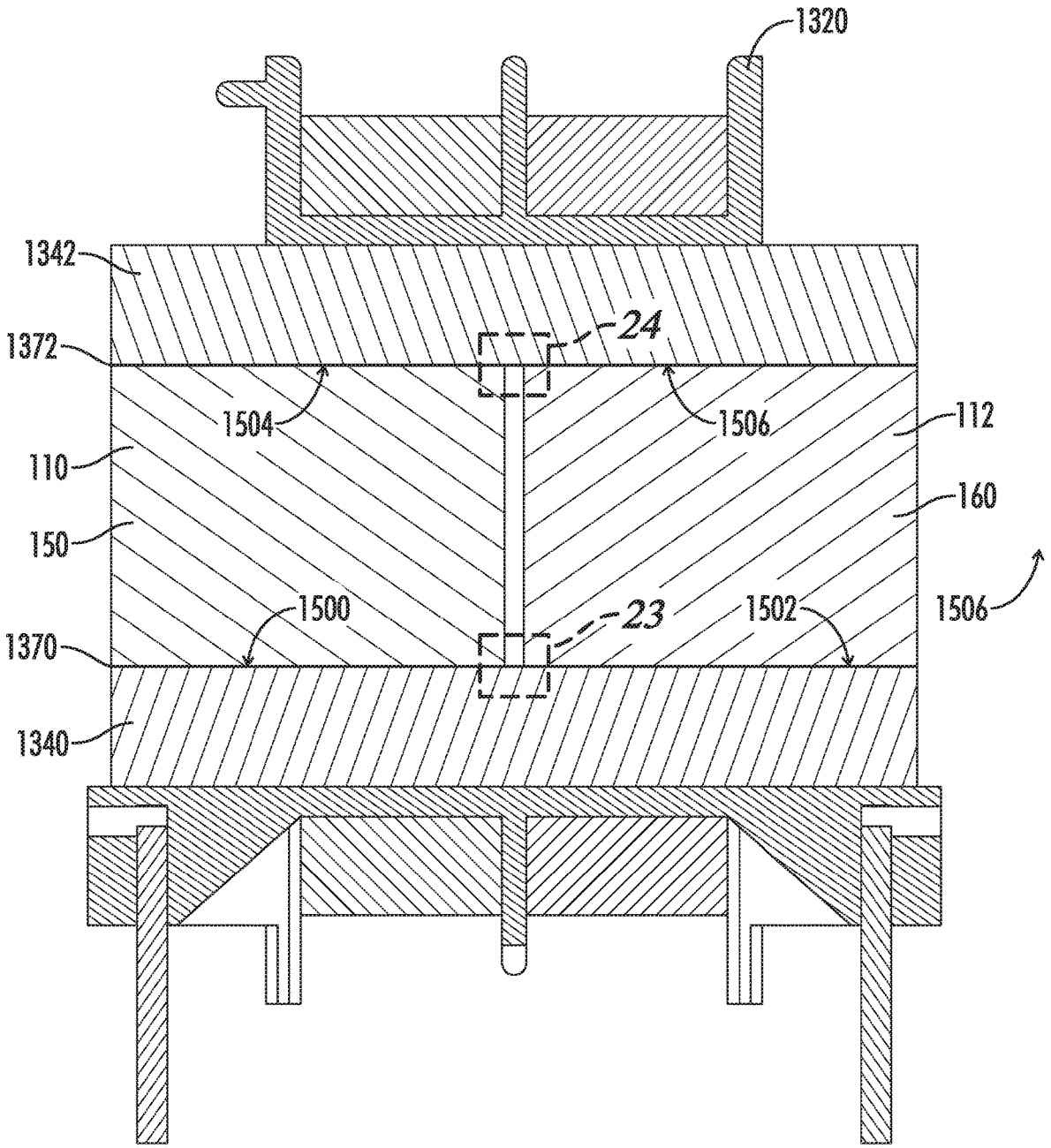
FIG. 22 illustrates an elevational cross-sectional view of the magnetic device of FIG. 20 taken along the line 22-22 in FIG. 20.
Figure 23:
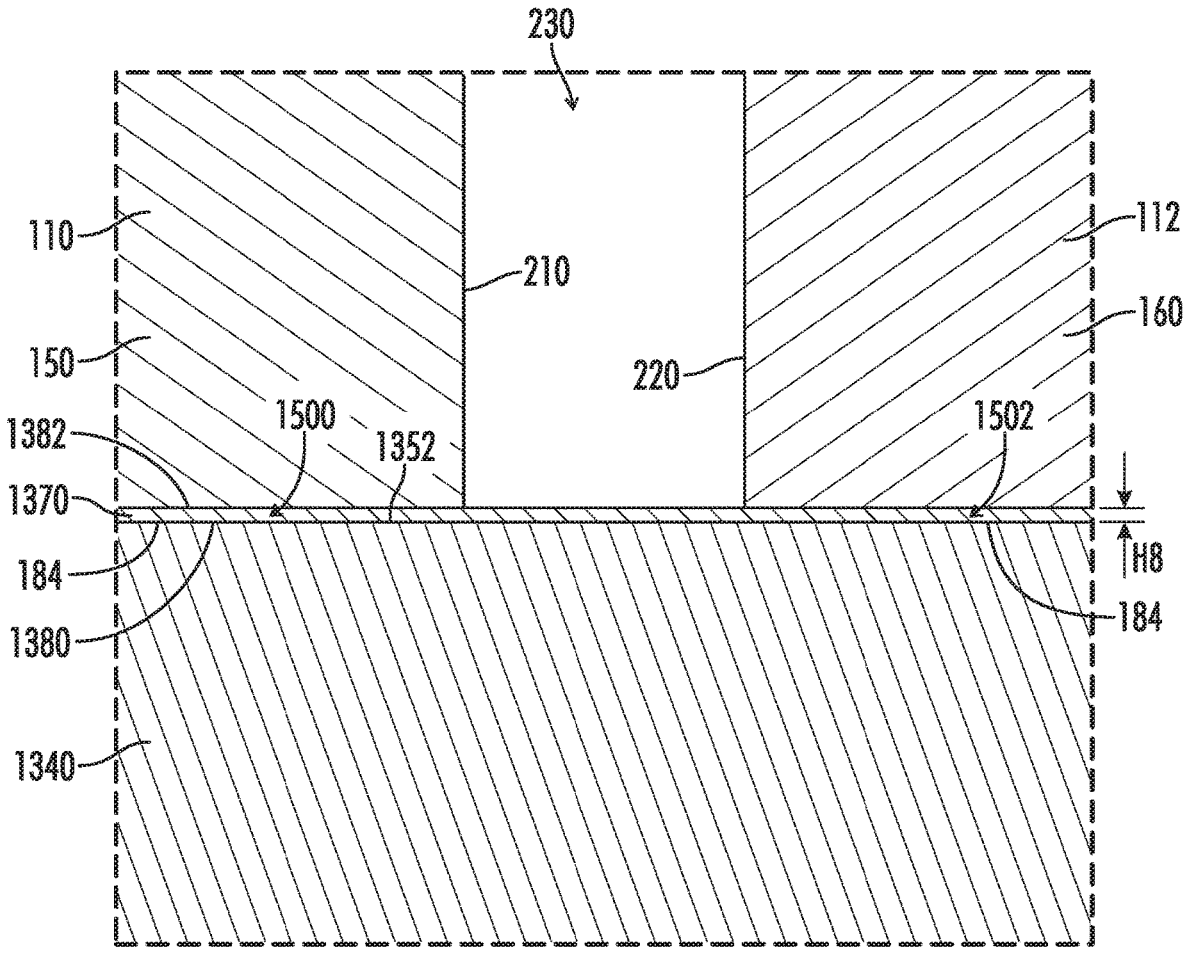
FIG. 23 illustrates an enlarged elevational cross-sectional view of the magnetic device of FIG. 20 taken within the dashed area 23 of FIG. 22.
Figure 24:
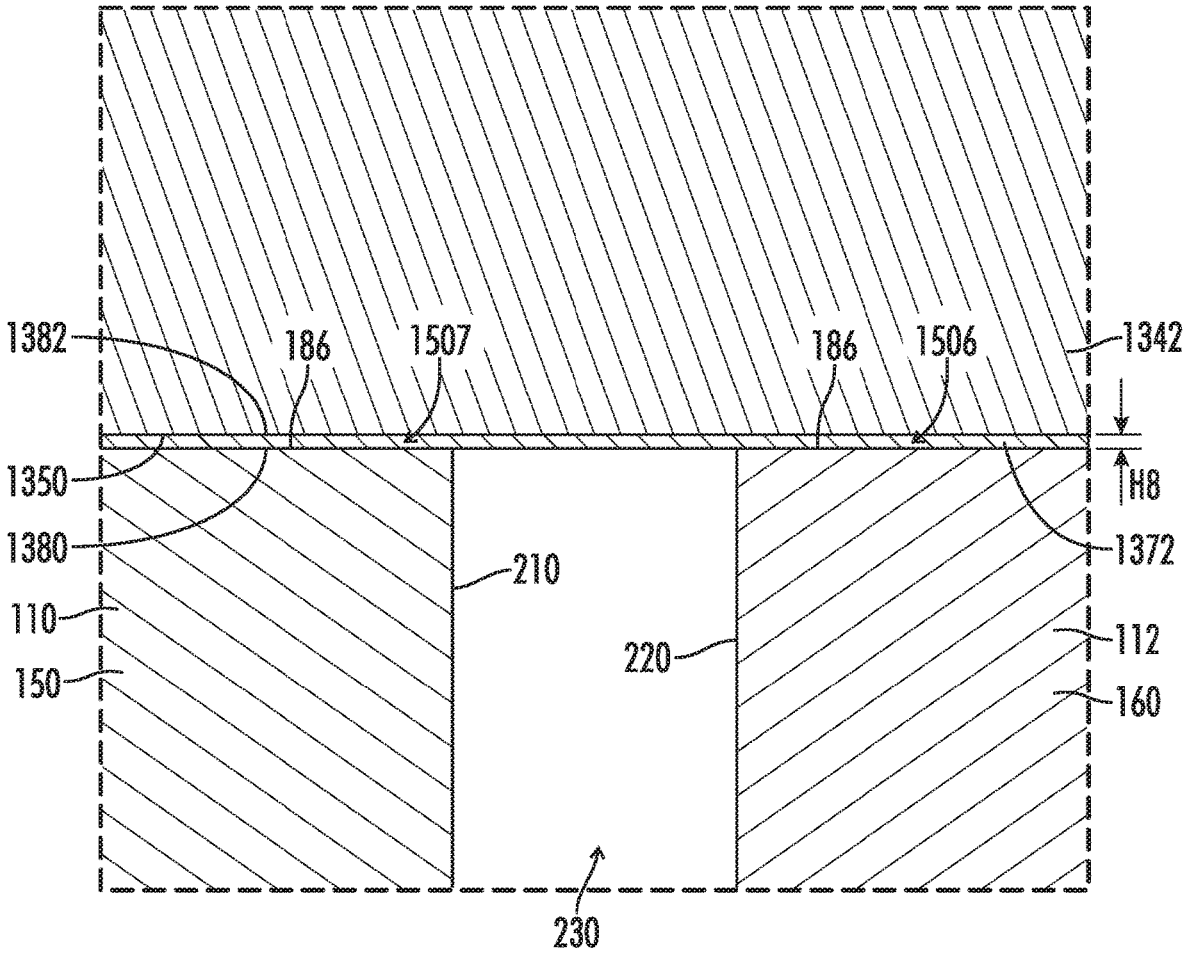
FIG. 24 illustrates an enlarged elevational cross-sectional view of the magnetic device of FIG. 20 taken within the dashed area 24 of FIG. 22.

The inductance of the inductor 900 is affected by the two thin gaps 980, 982 as illustrated by a curve 1210 of the DC bias characteristics of the inductor shown on a graph 1200 in FIG. 19. The previous curve 410 of the DC bias characteristics of the conventional inductor 100 and the previous curve 810 of the DC bias characteristics of the step-gap inductor 500 are also shown for comparison.

As illustrated by the curve 1210, a low DC bias currents, the I-bar 940 in combination with the two much thinner gaps 980, 982 between the I-bar 940 and the middle legs 150, 152 of the two E-cores 110, 112, provides a low reluctance magnetic path in parallel with the magnetic path through the much larger air gap 230 between the end surfaces 210, 220, respectively, of the middle legs of the two E-cores. The low reluctance path causes the inductor 900 to have a much higher inductance at low DC bias currents. For example, the total inductance peaks at approximately 10.2 millihenries at a DC bias of approximately 0.05 ampere. As the DC bias current increases above 0.05 ampere, the magnetic path through the I-bar and the two thin gaps begins to saturate, which causes a corresponding increase in the reluctance in the parallel magnetic path through the I-bar.

As the DC bias current continues to increase above 0.5 ampere, the reluctance in the parallel magnetic path continues to increase, which causes the inductance contribution of the parallel magnetic path through the I-bar 940 to continue to decrease at a greater rate. For example, the total inductance decreases to approximately 3.8 millihenries at a DC bias current of approximately 0.25 ampere. The total inductance continues to decrease at a lower rate as the DC bias current increases. At a DC bias current of approximately 0.7 ampere, the parallel magnetic path through the thin gaps 980, 982 and the I-bar is almost fully saturated, and the total inductance is determined almost entirely by the much larger gap 230 between the end surfaces 210, 220, respectively, of the middle legs 150, 160 of the two E-cores 110, 122. This effect is represented by the portion of the DC bias characteristics curve 1210 of the inductor 900 that follows the curve 410 of the conventional inductor when the DC bias exceeds approximately 0.7 ampere. In FIG. 19, the dashed line of the curve 1210 are offset from the solid line by a small amount at currents above 0.7 ampere to allow the dashed line to be seen; however, the dashed line may be coincident with the solid line at currents above 0.7 ampere.

As illustrated by the curve 1210 of the graph 1200 of FIG. 19, the inductor 900 of FIGS. 15-18 provides a combination of a high inductance at light loads (low DC bias currents) and a lower, approximately constant inductance at heavy loads. The lower inductance at the higher DC bias currents can be easily set by adjusting the length of the larger gap 230 between the end surfaces 210, 220, respectively, of the middle legs 150, 160 of the two E-cores 110, 122. The higher inductance at the lower DC bias currents can be set by adjusting the common thickness of the thin gaps 980, 982 (e.g., by selecting the thickness of the spacer 970). The thicknesses of the thin gaps may also be controlled by other techniques for spacing the lower surface 954 of the I-bar 940 apart from the upper surface 166 of the middle leg 150 of the first E-core 110 and the upper surface 186 of the middle leg 160 of the second E-core 112. For example, the illustrated continuous spacer of polyester film may be replaced with multiple spacers at selected locations between the juxtaposed surfaces. The inductance provided by the thin gaps may also be adjusted by adjusting the areas of the thin gaps. For example, the areas of the thin gaps may be decreased by reducing the length or the width or both the length and the width of the I-bar and thereby reducing the area of overlap between the I-bar and the upper surfaces of the middle legs of the E-cores.

FIGS. 20-24 illustrate an inductor 1300 configured in accordance with another embodiment of the present invention. The inductor 1300 is similar to the inductor 900 of FIGS. 15-18 and includes the first E-core 110 and the second E-core 112 as described above. The inductor 1300 includes a bobbin 1320 with a passageway 1322 as previously described. The passageway has a width W6 between a first inner side surface 1330 and a second inner side surface 1332. The width is selected to be approximately the same as, or slightly greater than, the width W1 of the middle legs 150, 160 of the two E-cores. The passageway has a height H6 between a lower inner surface 1334 and an upper inner surface 1336.

The inductor 1300 further includes a first I-bar 1340 and a second I-bar 1342. Each I-bar has a respective lower surface 1350, a respective upper surface 1352, a respective first side surface 1354, a respective second side surface 1356, a respective first end surface 1360 and a respective second end surface 1362. In the illustrated embodiment, each I-bar has a height H7 between the upper and lower surfaces, a width W7 between the first and second side surfaces and a length L7 between the first and second end surfaces. The height, width and length may correspond to the height width and length of the I-bar 940 of FIGS. 15-18; however, one or more of the dimensions (e.g., the height) may be different from the previously described embodiment.

The inductor further includes a first spacer 1370 and a second spacer 1372. Each spacer has a respective lower surface 1380 and a respective upper surface 1382. Because of the thinness of the spacers, the respective end surfaces and side surfaces are not numbered. Each spacer has a respective height H8 between the lower surface and the upper surface. In the illustrated embodiment, each spacer has a length L7 and a width W7 corresponding to the length and width of the I-bars; however, the length and width may differ in other embodiments.

The height H6 of the passageway 1322 is selected to accommodate the combined common height H1 of the middle legs 150, 160 of the two E-cores 110, 112, the combined heights (2×H7) of the first I-bar 1340 and the second I-bar 1342, and the combined heights (2×H8) of the first spacer 1370 and the second spacer 1372 (e.g., H6=H1+(2×H7)+(2×H8)).

As shown in FIGS. 20-24, the inductor 1300 is assembled by positioning the lower surface 1350 of the first I-bar 1340 on the lower inner surface 1334 of the passageway 1320. The lower surface 1380 of the first spacer 1370 is positioned on the upper surface 1352 of the first I-bar. The middle legs 150, 160 of the two E cores 110, 112 are positioned in the passageway with the respective lower surfaces 184 of each middle leg positioned on the upper surface 1382 of the first spacer. The lower surface 1380 of the second spacer 1372 is positioned on the respective upper surfaces 186 of the middle legs of the two E-cores. The lower surface 1350 of the second I-bar 1342 is positioned on the upper surface 1382 of the second spacer.

When the assembly of the inductor 1300 is completed, the five components fit within the passageway as shown in the cross-sectional views in FIGS. 15, 22, 23 and 24. As illustrated, the two I-bars 1340, 1342 and the two spacers 1370, 1372 form four thin magnetic gaps with respect to the middle legs 150, 160 of the two E-cores 110, 112. The first spacer 1370 forms a first thin magnetic gap 1500 between the upper surface 1352 of the first I-bar and the lower surface 184 of the middle leg of the first E-core 110. The first spacer also forms a second thin magnetic gap 1502 between the upper surface of the first I-bar and the lower surface 184 of the middle leg of the second E-core 112. The second spacer 1372 forms a third thin magnetic gap 1504 between the upper surface 186 of the middle leg of the first E-core and the lower surface 1350 of the second I-bar 1342. The second spacer also forms a fourth thin magnetic gap 1506 between the upper surface 186 of the middle leg of the second E-core and the lower surface of the second I-bar.

Figure 25:
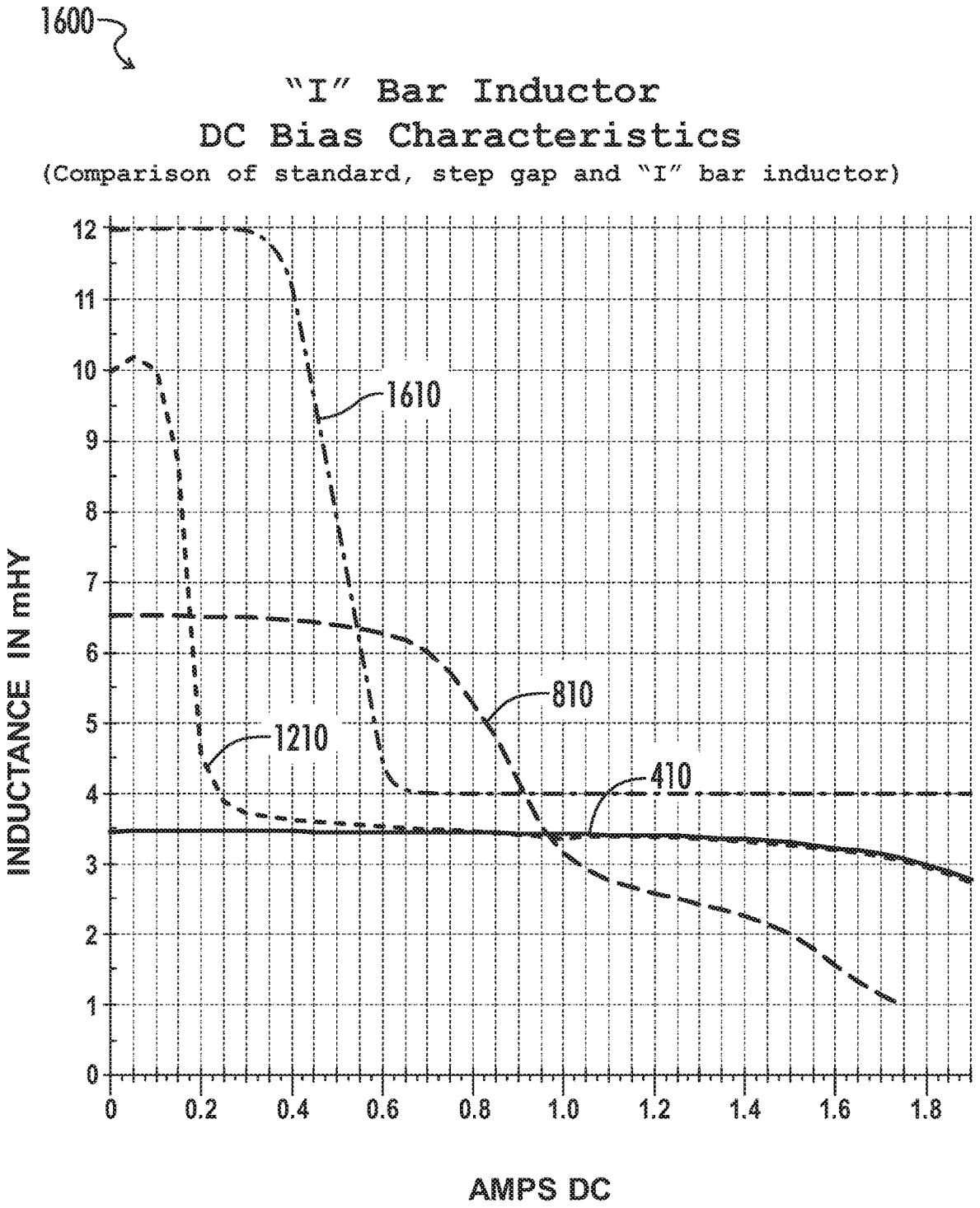
FIG. 25 illustrates a graph of the DC bias characteristics of the magnetic component of FIGS. 20-24 in comparison with the DC bias characteristics of the magnetic component of FIGS. 1-7, the DC bias characteristics of the magnetic component of FIGS. 9-13, and the DC bias characteristics of the magnetic component of FIGS. 15-18.

The inductor 1300 of FIGS. 20-24 operates in a similar manner to the inductor 900 of FIGS. 15-18 as illustrated by a curve 1610 of the DC bias characteristics of the inductor shown on a graph 1600 in FIG. 25. At low DC bias currents, the first thin gap 1500, the second thin gap 1502 and the first I-bar 1340 form a first low-reluctance magnetic path in parallel with the magnetic path through the much larger air gap 230 between the end surfaces 210, 220, respectively, of the middle legs of the two E-cores 110, 112. Also, at low DC bias currents, the third thin gap 1504, the fourth thin gap 1506 and the second I-bar 1342 form a second low-reluctance magnetic path in parallel with the magnetic path through the much larger air gap between the end surfaces of the middle legs of the two E-cores. The two low-reluctance parallel magnetic paths cause the inductor 1300 to have a much higher total inductance at low DC bias currents. For example, the total inductance is approximately 12 millihenries at a DC bias of approximately 0 ampere. When the DC bias current increases to approximately 0.4 ampere, the magnetic paths through the two I-bars and the two thin gaps associated with each I-bar begin to saturate. The saturations of the two paths cause a corresponding increase in the reluctance in the magnetic paths, which results in a decrease of the additional inductance provided by each path. The total inductance continues to decrease to approximately 4.0 millihenries as the current increases to approximately 0.6 ampere. At DC bias currents above approximately 0.6 ampere, the total inductance remains substantially constant at approximately 4.0 millihenries with the magnetic path through the larger air gap between the ends of the two middle legs of the E-cores providing a much greater portion of the inductance.

The inductor 900 and the inductor 1300 have a number of advantages. For example, unlike the inductor 500 having a step-gap core, the inductor 900 and the inductor 1300 require only a single gap length between the end surfaces of the middle legs and are therefore much easier to manufacture. The parallel magnetic paths provided by the I-bars positioned across the air gap between the end surfaces of the middle legs increases the maximum inductance at light loads (e.g., low DC bias currents). The maximum inductance at light loads is easy to adjust by varying the spacing between the surfaces of the middle legs of the E-cores and the surface of the single I-bar or between the surfaces of the middle legs and the surfaces of the two I-bars.

In the illustrated embodiment, the four thin gaps 1500, 1502, 1504, 1506 have substantially the same gap lengths. In alternative embodiments, the gap lengths 1500, 1502 between the first I-bar 1340 and the middle legs 150, 160 may differ from the gap lengths 1504, 1506 between the second I-bar 1342 and the middle legs. The magnetic path incorporating the thinner pair of gaps will saturate at lower DC bias currents causing an initial decrease in the inductance over a first current range. The magnetic path through the thicker pair of gaps will saturate at higher DC bias currents causing a second decrease in the inductance over a second current range. The two current ranges may overlap such or may be spaced apart. For example, if the two current range overlap, the inductance may initially begin to decrease at a first rate over the first current range and then decrease at a second rate when the DC bias current reaches the second current range. If the two current ranges do not overlap, the inductance may initially decrease to a first level over the first current range, remain approximately constant over an interim range of currents, and then decrease further over the second current range. As discussed above, the gap lengths and the gap areas may be adjusted to determine the ranges of currents over which the inductances vary.

The previous detailed description has been provided for the purposes of illustration and description. Thus, although there have been described particular embodiments of the present invention of a new and useful "Inductor with Flux Path for High Inductance at Low Load," it is not intended that such references be construed as limitations upon the scope of this invention except as set forth in the following claims.

What is claimed is:

1. A magnetic component comprising:

a bobbin having a first end flange, a second end flange and a passageway through the bobbin from the first end flange to the second end flange;

at least one coil positioned around the passageway between the first end flange and the second end flange;

a first E-core and a second E-core, each E-core having a respective main body, a respective middle leg, a respective first outer leg and a respective second outer leg, the legs of each E-core extending from the respective main body to respective end surfaces, the middle legs of the two E-cores positioned in the passageway of the bobbin with the respective end surfaces of the middle legs juxtaposed within the passageway and spaced apart by a first magnetic gap, each middle leg having a respective first longitudinal surface perpendicular to the respective end surface, the first and second outer legs of the two E-cores positioned outside the bobbin with the end surface of the first outer leg of the first E-core engaging the end surface of the first outer leg of the second E-core and with the end surface of the second outer leg of the first E-core engaging the second outer leg of the second E-core; and a first I-bar positioned in the passageway in alignment with the middle leg of the first E-core and in alignment with the middle leg of the second E-core, the first I-bar spanning the first magnetic gap with a first portion of the first I-bar parallel to and spaced apart from the first longitudinal surface of the middle leg of the first E-core to form a second magnetic gap between the first I-bar and the longitudinal surface of the middle leg of the first E-core with at least a portion of the second magnetic gap positioned within the passageway, and with a second portion of the first I-bar parallel to and spaced apart from the first longitudinal surface of the middle leg of the second E-core to form a third magnetic gap between the first I-bar and the longitudinal surface of the middle leg of the second E-core with at least a portion of the third magnetic gap positioned within the passageway.

2. The magnetic component of claim 1, further including a spacer positioned between the I-bar and the longitudinal surface of the middle leg of the first E-core, the spacer having a thickness that defines the second magnetic gap.

3. The magnetic component of claim 2, wherein the spacer is also positioned between the I-bar and the longitudinal surface of the middle leg of the second E-core.

4. The magnetic component of claim 1, further comprising:

a respective second longitudinal surface of each middle leg, each respective second longitudinal surface parallel to the respective first longitudinal surface; and a second I-bar, the second I-bar parallel to and spaced apart from the second longitudinal surface of the middle leg of the first E-core by a fourth magnetic gap, the second I-bar parallel to and spaced apart from the second longitudinal surface of the middle leg of the second E-core by a fifth magnetic gap.

5. The magnetic component of claim 4, wherein the fourth and fifth magnetic gap have substantially the same length as the second and third magnetic gap.

6. The magnetic component of claim 1, wherein the middle leg of each of the first E core and the second E-core has a height substantially equal to a height of each of the first outer leg and the second outer leg.

7. A method for constructing a magnetic component comprising:

positioning at least one coil onto a bobbin, the bobbin having a first end flange, a second end flange and a passageway through the bobbin from the first end flange to the second end flange, the at least one coil positioned around the passageway of the bobbin between the first end flange and the second end flange;

providing a first E-core and a second E-core, each E-core having a body portion, a respective first outer leg, a respective second outer leg and a respective middle leg, each leg of each core having a respective end surface, each middle leg having a respective longitudinal surface extending from the body portion to the respective end surface of the middle leg;

inserting the middle leg of the first E-core into a first end of the passageway proximate to the first end flange, and inserting the middle leg of the second E-core into a second end of the passageway proximate to the second end flange, the middle legs positioned in the passageway with the end surfaces spaced apart from each other to form a first magnetic gap, the outer legs positioned outside the passageway with the end surface of the first outer leg of the first E-core engaging the end surface of the first outer leg of the second E-core and with the end surface of the second outer leg of the first E-core engaging the end surface of the second outer leg of the second E-core; and positioning a first I-bar in the passageway in alignment with the middle legs of the two E-cores, the first I-bar spanning the first magnetic gap, the first I-bar having a first portion positioned parallel to and spaced apart from the longitudinal surface of the middle leg of the first I-core to form a second magnetic gap between the first I-bar and the longitudinal surface of the middle leg of the first E-core with at least a portion of the second magnetic gap positioned within the passageway, the first I-bar having a second portion positioned parallel to and spaced apart from the longitudinal surface of the middle leg of the second I-core to form a third magnetic gap between the first I-bar and the longitudinal surface of the middle leg of the second E-core with at least a portion of the third magnetic gap positioned within the passageway.

8. The method of claim 7, further comprising positioning a spacer between the first I bar and the longitudinal surface of the middle leg of the first E-core, the spacer having a thickness that defines the second magnetic gap.

9. The method of claim 8, wherein the spacer is also positioned between the first I bar and the longitudinal surface of the middle leg of the second E-core.

10. The method of claim 7, further comprising:

positioning a second I-bar into the passageway, the second I-bar positioned parallel to and spaced apart from a second longitudinal surface of the middle leg of the first E-core by a fourth magnetic gap, the second I-bar positioned parallel to and spaced apart from the second longitudinal surface of the middle leg of the second E-core by a fifth magnetic gap.

11. The method of claim 10, wherein the fourth and fifth magnetic gap have substantially the same length as the second and third magnetic gap.

12. The method of claim 7, wherein the middle leg of each of the first E core and the second E-core has a height substantially equal to a height of each of the first outer leg and the second outer leg.

13. A method for controlling the inductance of a magnetic component to provide a first range of inductances over a first range of DC bias currents and to provide a second range of inductances over a second range of DC bias currents, the method comprising:

providing a magnetic component by positioning at least one coil around a passageway of a bobbin, inserting a respective middle leg of a first E-core into the passageway from a first end of the passageway, the middle leg of the first E-core having a respective end surface and a respective longitudinal surface, the longitudinal surface of middle leg of the first E-core perpendicular to the end surface of the middle leg of the first E-core, each of the first outer leg and the second outer leg of the first E-core parallel to and spaced apart from the middle leg of the first E-core, each of the first outer leg and the second outer leg of the first E-core having a respective end surface, inserting a respective middle leg of a second E-core into the passageway from a second end of the passageway, the second middle leg having a respective end surface and a respective longitudinal surface, the longitudinal surface of the middle leg of the second E-core perpendicular to the end surface of the middle leg of the second E-core, the end surface of the middle leg of the second E-core parallel to and spaced apart from the end surface of the middle leg of the first E-core by a first magnetic gap, each of the first outer leg and the second outer leg of the second E-core parallel to and spaced apart from the middle leg of the second E-core, each of the first outer leg and the second outer leg of the second E-core having a respective end surface, the end surface of the first outer leg of the first E-core engaging the end surface of the first outer leg of the second E-core, the send surface of the second outer leg of the first E-core engaging the end surface of the second outer leg of the second E-core, and inserting a first I-bar into the passageway in alignment with the middle leg of the first E-core and the middle leg of the second E-core, the first I-bar spanning the first magnetic gap, the first I-bar having a first portion with a longitudinal surface parallel to and spaced apart from the longitudinal surface of the middle leg of the first E-core by a second magnetic gap with at least a portion of the second magnetic gap positioned within the passageway, the first I-bar having a second portion with a longitudinal surface parallel to and spaced apart from the longitudinal surface of the middle leg of the second E-core by a third magnetic gap with at least a portion of the third magnetic gap positioned within the passageway;

applying a first DC bias current to the at least one coil, the first DC bias current having a first magnitude in a first range of current magnitudes, the first range of current magnitudes selected to be less than a current magnitude that saturates a magnetic path through the second magnetic gap, the third magnetic gap and the I-bar, the magnetic component having a first range of inductances when the DC bias current has a magnitude in the first range of current magnitudes; and applying a second DC bias current to the at least one coil, the second DC bias current having a magnitude in a second range of current magnitudes, the second range of current magnitudes selected to be at least sufficient to cause the magnetic path through the second magnetic gap, the third magnetic gap and the I-bar to saturate, the magnetic component having a second range of inductances when the DC bias current has a magnitude in the second range of current magnitudes, wherein each inductance in the second range of inductances is less than inductances in the first range of inductances.

14. The method of claim 13 further comprising positioning a spacer between the first I bar and the longitudinal surface of the first middle leg, the spacer having a thickness that defines the second magnetic gap.

15. The method of claim 14, wherein the spacer is also positioned between the first I bar and the longitudinal surface of the second middle leg.

16. The method of claim 13, further comprising:

positioning a second I-bar into the passageway, the second I-bar positioned parallel to and spaced apart from a second longitudinal surface of the first middle leg by a fourth magnetic gap, the second I-bar positioned parallel to and spaced apart from the second longitudinal surface of the second middle leg by a fifth magnetic gap.

17. The method of claim 16, wherein the fourth and fifth magnetic gap have substantially the same length as the second and third magnetic gap.

18. The method of claim 13, wherein the middle leg of each of the first E core and the second E-core has a height substantially equal to a height of each of the first outer leg and the second outer leg.

* * * * *